US010886042B2

(12) United States Patent
Mabuchi et al.

(10) Patent No.: US 10,886,042 B2
(45) Date of Patent: Jan. 5, 2021

(54) TWISTED WIRE MANUFACTURING APPARATUS AND TWISTED WIRE MANUFACTURING METHOD

(71) Applicant: Yazaki Corporation, Tokyo (JP)

(72) Inventors: Miyoshi Mabuchi, Makinohara (JP); Nobuto Tsukiji, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 86 days.

(21) Appl. No.: 16/357,486

(22) Filed: Mar. 19, 2019

(65) Prior Publication Data

US 2019/0214165 A1 Jul. 11, 2019

Related U.S. Application Data

(63) Continuation of application No. PCT/JP2017/033680, filed on Sep. 19, 2017.

(30) Foreign Application Priority Data

Sep. 20, 2016 (JP) ..... 2016-182672

(51) Int. Cl.
*H01B 13/02* (2006.01)

(52) U.S. Cl.
CPC ..... *H01B 13/02* (2013.01); *H01B 13/0207* (2013.01)

(58) Field of Classification Search
CPC ..... H01B 13/02; H01B 13/0207; B21F 7/00
See application file for complete search history.

(56) References Cited

U.S. PATENT DOCUMENTS 800,774 A * 10/1905 Turner ..... D07B 3/14 57/27
1,430,519 A * 9/1922 Cattoor ..... B65H 3/46 57/27
2,935,838 A * 5/1960 Briscoe ..... D07B 3/12 57/21

(Continued)

FOREIGN PATENT DOCUMENTS

CN 201289764 Y 8/2009
CN 103632772 A 3/2014

(Continued)

OTHER PUBLICATIONS

English translation of Written Opinion (PCT/ISA/237) issued by the International Searching Authority in corresponding International Application No. PCT/JP2017/033680, dated Dec. 5, 2017.

(Continued)

*Primary Examiner* — Shaun R Hurley
(74) *Attorney, Agent, or Firm* — Sughrue Mion, PLLC

(57) ABSTRACT

An apparatus (1) is designed to manufacture a twisted wire by twisting a plurality of electric wires (101), and includes an raising and lowering unit (2), an twisting unit (3), and a control unit (4). The raising and lowering unit lifts the plurality of electric wires and lowers the manufactured twisted wire, and includes: a raising and lowering portion (6); a guiding portion (7) vertically guiding the raising and lowering portion; and a raising and lowering mechanism (8) capable of switching a raising and lowering speed of the raising and lowering portion to a high speed or a low speed.

4 Claims, 24 Drawing Sheets

(56) References Cited

U.S. PATENT DOCUMENTS

| | | | | |
|---|---|---|---|---|
| 5,517,813 | A * | 5/1996 | Klundt | B21F 15/04 140/49 |
| 5,603,207 | A * | 2/1997 | Hartman | D07B 3/12 57/25 |
| 5,946,897 | A * | 9/1999 | Ichikawa | H01B 13/0207 140/149 |
| 7,647,759 | B2 * | 1/2010 | Braun | H01R 43/28 57/2.3 |
| 7,987,659 | B2 * | 8/2011 | Song | H05B 3/56 57/314 |
| 9,416,488 | B2 * | 8/2016 | Stier | D07B 3/04 |
| 10,441,993 | B2 * | 10/2019 | Galdamez Morales | H01B 13/01236 |
| 2009/0241314 | A1 * | 10/2009 | Watanabe | H01B 13/0271 29/33 F |
| 2017/0350071 | A1 * | 12/2017 | Mabuchi | B21F 7/00 |
| 2018/0204655 | A1 * | 7/2018 | Mabuchi | H01B 13/0207 |
| 2019/0214166 | A1 * | 7/2019 | Shirai | B21F 15/04 |

FOREIGN PATENT DOCUMENTS

| | | | |
|---|---|---|---|
| JP | 2001-35283 | A | 2/2001 |
| JP | 2008-277032 | A | 11/2008 |
| WO | 2015/190583 | A1 | 12/2015 |

OTHER PUBLICATIONS

International Search Report (PCT/ISA/210) dated Dec. 5, 2017 issued by the International Searching Authority in International Application No. PCT/JP2017/033680.

Written Opinion (PCT/ISA/237) dated Dec. 5, 2017 issued by the International Searching Authority in International Application No. PCT/JP2017/033680.

* cited by examiner (b)

TWISTED WIRE MANUFACTURING APPARATUS AND TWISTED WIRE MANUFACTURING METHOD

CROSS-REFERENCE TO RELATED APPLICATIONS

This is a continuation of International Application No. PCT/JP2017/033680 filed on Sep. 19, 2017, and claims priority from Japanese Patent Application No. 2016-182672 filed on Sep. 20, 2016, the entire content of which is incorporated herein by reference.

BACKGROUND

Field of the Invention

The present invention relates to a twisted wire manufacturing apparatus and a twisted wire manufacturing method for manufacturing a twisted wire by twisting a plurality of electric wires.

Description of Related Art

For example, in order to electrically connect devices mounted on an automobile, an electric wire harness is wired in a vehicle. The electric wire harness generally includes a plurality of sub-harnesses. The electric wire harness having such configuration is manufactured by combining the sub-harnesses so as to fit a desired circuit pattern. Examples of an electric wire constituting the sub-harnesses includes a twisted pair wire (twisted wire).

As shown in FIGS. 21A and 21B, a twisted wire 102 is manufactured by twisting two electric wires 101. Examples of an apparatus for manufacturing the twisted wire 102 include an apparatus (electric wire twisting apparatus) including a work table, a holding portion for holding one end of two electric wires on the work table, a motor for rotating the holding portion around and axis, a pair of rotational holding portion obtained by providing in parallel single-core holding portions for holding the other end of each electric wire in a manner rotatable around an axis, a movable holding portion provided so as to be movable along the axis, a drive portion for moving the movable holding portion along the axis, and a control portion for controlling a moving speed of the movable holding portion.

As for details of the above apparatus, refer to JP 2008-277032 A.

SUMMARY

In the above-described related art, since the twisted wire 102 is manufactured in a linearly long state, in order to manufacture such a twisted wire 102, it is necessary to secure at least a space having a length equal to or longer than a length of the electric wires 101 (that is, long in a horizontal direction) as an installation space of the apparatus. Moreover, in the above-described related technique, an operator moves from one end to the other end of the electric wires 101 so as to hold both ends of the electric wires 101 in the holding portion and the rotational holding portion, which makes it difficult to improve workability.

To improve workability of the latter, for example, if the apparatus is configured to hold the one end and the other end of the electric wires 101 respectively on predetermined members in the vicinity of the operator and to automatically move the member on the other end side to a predetermined position, the movement of the operator can be avoided. However, in a case where a large tension is applied to the electric wires 101 upon movement of the member on the other end side, there is a risk of trouble such that the ends of the electric wires 101 may be detached from the members holding the ends of the electric wires 101.

An object of the present invention is to provide a twisted wire manufacturing apparatus and a method of manufacturing a twisted wire capable of improving workability without reducing an installation space and causing an excessive tension in an electric wire.

Embodiments of the "twisted wire manufacturing apparatus" according to the present invention provide the following items (1) to (3).

(1) An apparatus for manufacturing a twisted wire by twisting a plurality of electric wires, the apparatus comprising:

a raising and lowering unit lifting the plurality of the electric wires and lowering the manufactured twisted wire;

a twisting unit disposed with the raising and lowering unit and twisting the plurality of the electric wires; and a control unit controlling at least the raising and lowering unit, the raising and lowering unit having:

a raising and lowering portion; a guiding portion vertically guiding the raising and lowering portion; and a raising and lowering mechanism capable of switching a raising and lowering speed of the raising and lowering portion to a high speed or a low speed.

(2) The apparatus according to the item (1), wherein the raising and lowering portion has:

a hanging portion hanging and lifting intermediate portions between both ends of the electric wires; and a main body of the raising and lowering portion, the main body being combined with the electric wire hanging portion.

(3) The apparatus according to the item (2), wherein the twisting unit has:

a one-end chuck portion chucking one end of the electric wires; an other-end chuck portion chucking the other end of the electric wires; a co-rotation portion rotating the one-end chuck portion and the other-end chuck portion in the same direction at different timings; and a position-changing mechanism changing positions of the one-end chuck portion and the other-end chuck portion in a vertical direction.

Embodiments of the "twisted wire manufacturing method" according to the present invention provide the following item (4).

(4) A method for manufacturing a twisted wire by twisting a plurality of electric wires, the method comprising:

hanging intermediate portions between both ends of the electric wires to a hanging portion;

chucking one end of the electric wires to an one-end chuck portion;

lifting the electric wires to a position of a preset lifting height through movement of the hanging portion in a state of the intermediate portions being hanged to the hanging portion and the one end of the electric wires being chucked to the one-end chuck portion;

chucking the other end of the electric wires to an other-end chuck portion after lifting the electric wires to the position of the preset lifting height; and twisting the electric wires in a state of the electric wires being raised to the position of the preset lifting height and the one end and the other end of the electric wires being chucked, the lifting step including:

both of a first lifting step lifting the electric wires at a high speed to a first preset position lower than the position of the preset lifting height; and a second lifting step lifting the electric wire located at the first preset position at a low speed to a second preset position corresponding to the position of the preset lifting height, or, the lifting step including:

a third lifting step lifting the electric wires at the low speed to the position of the preset lifting height.

According to the first aspect of the invention, relating to the above item (1), since a space required for manufacturing the twisted wire is secured in the vertical direction, a space required in the horizontal direction can be significantly reduced as compared to conventional examples. Moreover, since an operator does not need to move from one end to the other end of the electric wires, the burden on the operator can be reduced. Further, since the raising/lowering speed of the electric wires can be changed, for example, if the raising/lowering speed is switched from the high speed to the low speed before reaching the position of the desired lifting height, or if the raising/lowering speed is maintained at the low speed until the position of the desired lifting height, it is possible to prevent a large tension from being abruptly generated to the electric wires. As a result, it is possible to prevent troubles such as detachment of the ends of the electric wires from the members holding the ends of the electric wires. Therefore, the twisted wire manufacturing apparatus according to the present configuration is capable of reducing the installation space and improving the workability without causing excessive tension in the electric wire.

According to the second aspect of the invention, relating to the above item (2), by hanging and lifting the intermediate portion of the electric wires to the electric wire hanging portion, the electric wires are bent in a U shape, and both ends of the electric wires can be arranged at a position close to the operator. Therefore, the height of the apparatus can be reduced and the installation space of the apparatus can be further reduced as compared to a case where the electric wires are not bent in such a manner.

According to the third aspect of the invention, relating to the above item (3), since the electric wire twisting unit includes the one-end chuck portion, the other-end chuck portion, the co-rotation portion, and the chuck vertical position-changing mechanism, it is possible to normally twist the entire electric wires including the intermediate portion hanged to the electric wire hanging portion.

According to the fourth aspect of the invention, relating to the above item (4), since a space required for manufacturing the twisted wire is secured in the vertical direction, a space required in the horizontal direction can be significantly reduced as compared to conventional examples. Moreover, since an operator does not need to move from one end to the other end of the electric wires, the burden on the operator can be reduced. Further, since the raising/lowering speed of the electric wires can be changed, for example, if the raising/lowering speed is switched from the high speed to the low speed before reaching the position of the desired lifting height, or if the raising/lowering speed is maintained at the low speed until the position of the desired lifting height, it is possible to prevent a large tension from being abruptly generated to the electric wires. As a result, it is possible to prevent troubles such as detachment of the ends of the electric wires from the members holding the ends of the electric wires. Further, by hanging and lifting the intermediate portion of the electric wires to the electric wire hanging portion, the electric wires are bent in a U shape, and both ends of the electric wires can be arranged at a position close to the operator. Therefore, the height of the apparatus can be reduced and the installation space of the apparatus can be further reduced as compared to a case where the electric wires are not bent in such a manner. Therefore, the twisted wire manufacturing apparatus according to the present configuration is capable of reducing the installation space and improving the workability without causing excessive tension in the electric wire.

BRIEF DESCRIPTION OF DRAWINGS

FIG. 21A shows a state in which two electric wires are arranged, and FIG. 21B shows a twisted wire.

DETAILED DESCRIPTION

The twisted wire manufacturing apparatus is an apparatus for manufacturing a twisted wire by twisting at least two electric wires, and includes an electric wire raising/lowering unit, an electric wire twisting unit, and a control unit. The electric wire raising/lowering unit is a unit for lifting the electric wires and lowering the manufactured twisted wire, and includes: a raising/lowering portion; a raising/lowering guidance portion configured to vertically guide the raising/lowering portion; and a high-speed/low-speed raising/lowering mechanism capable of switching a raising/lowering speed of the raising/lowering portion to a high speed or a low speed.

EMBODIMENTS

Figure 1:
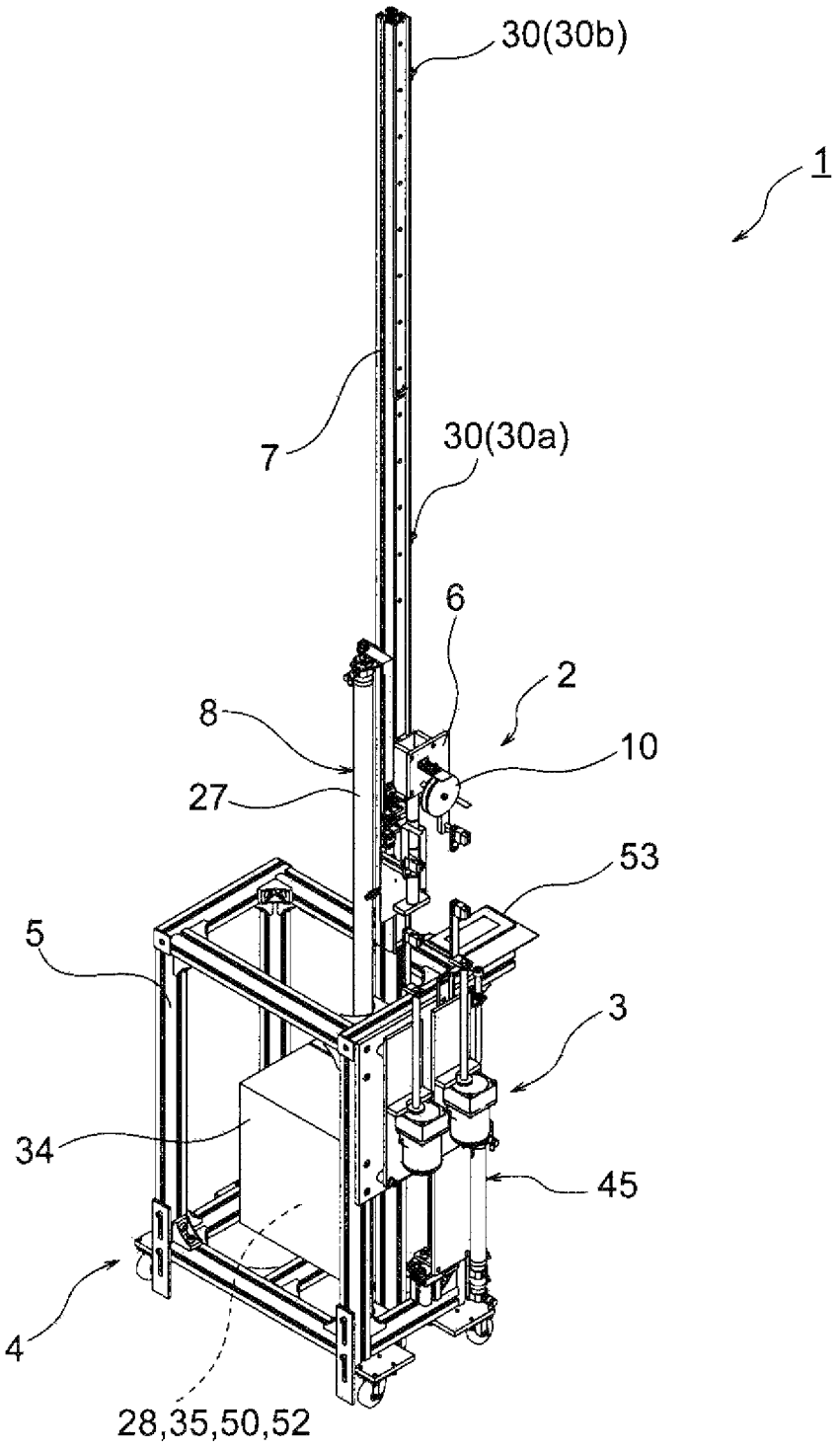
FIG. 1 is a perspective view of a twisted wire manufacturing apparatus according to an embodiment of the present invention.
Figure 2:
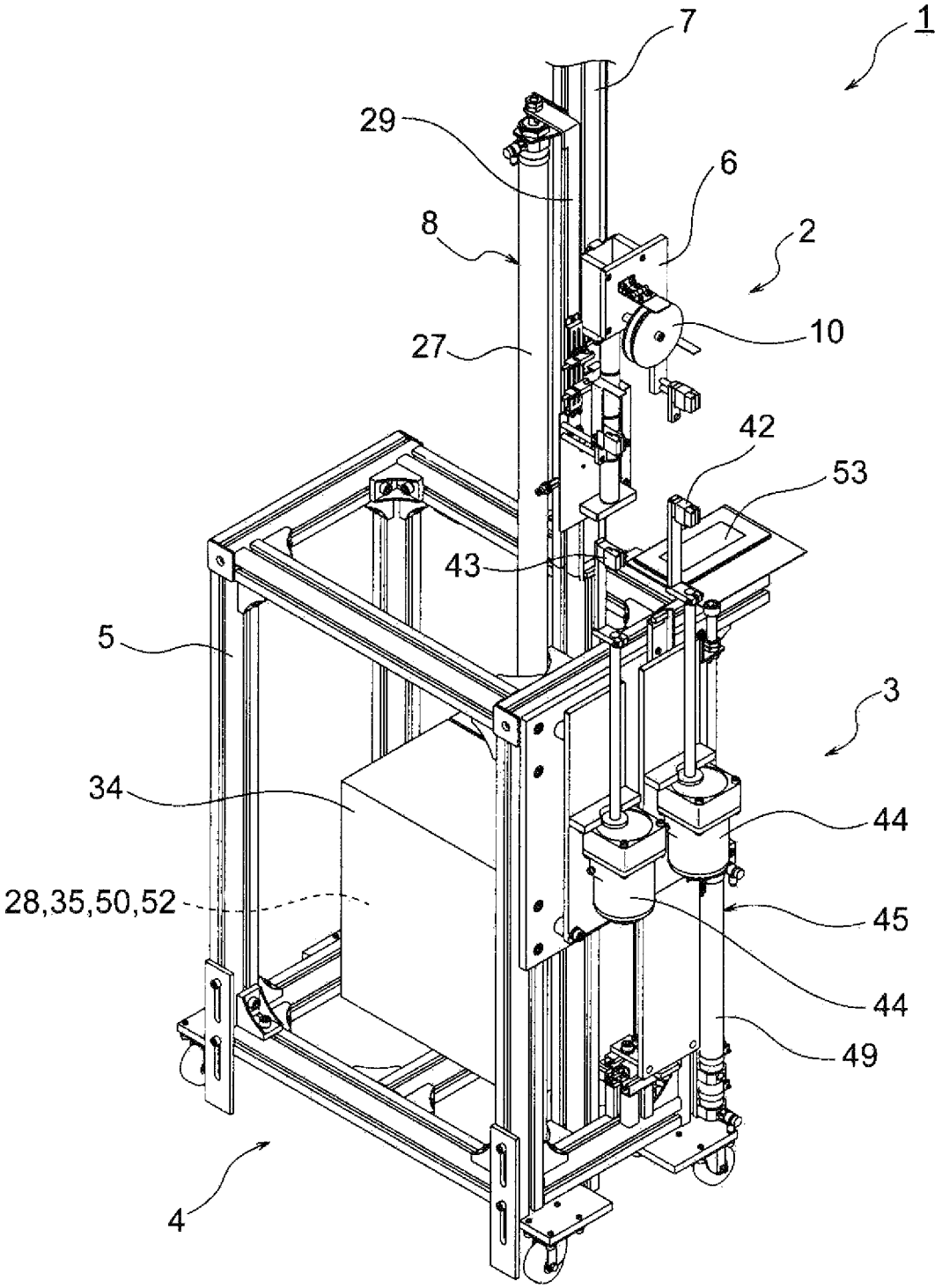
FIG. 2 is an enlarged view of a lower portion of the twisted wire manufacturing apparatus of FIG. 1.
Figure 3:
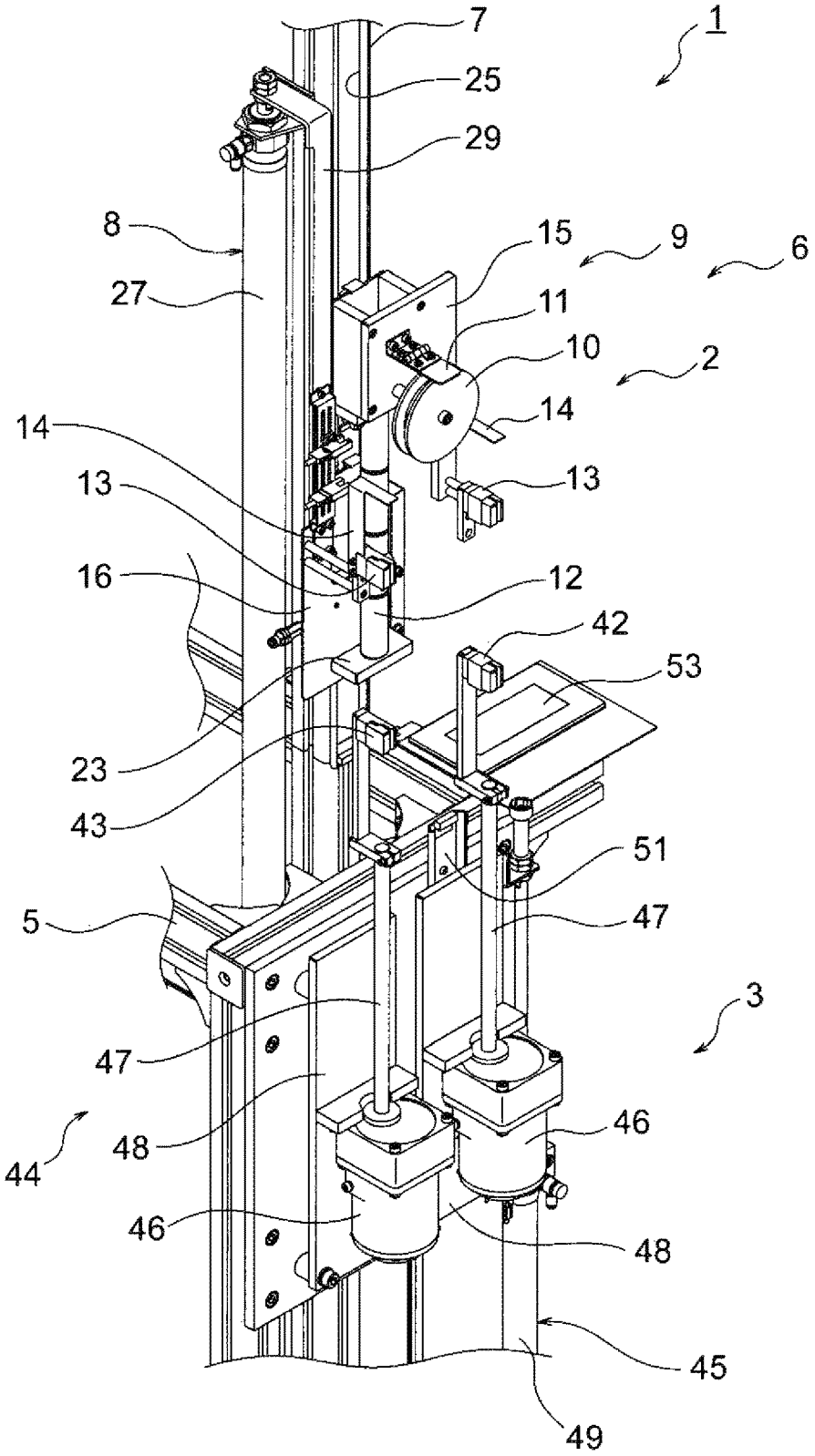
FIG. 3 is an enlarged view of a main part of FIG. 2.
Figure 4:
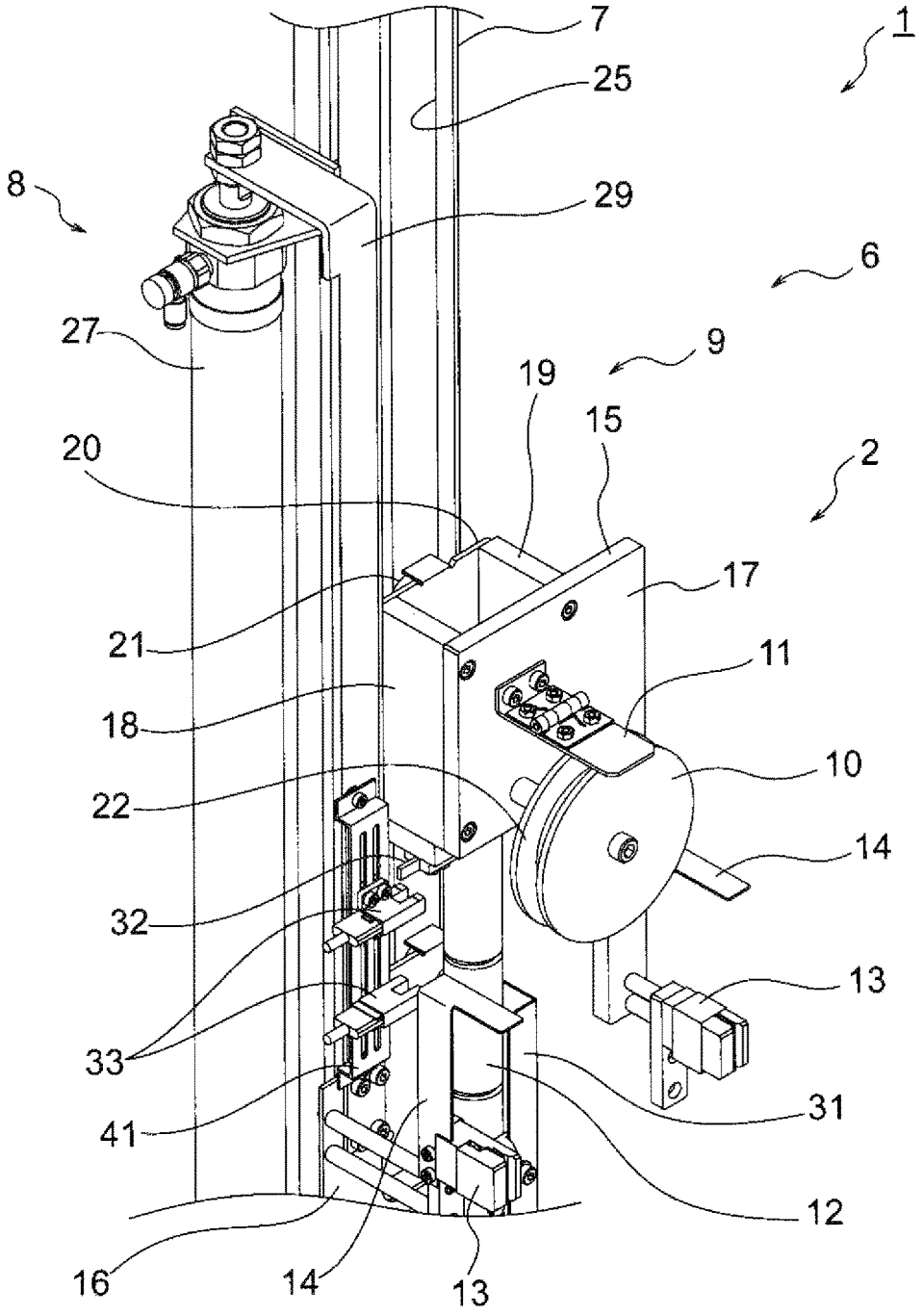
FIG. 4 is an enlarged view of the electric wire raising/lowering unit of FIG. 3.
Figure 5:
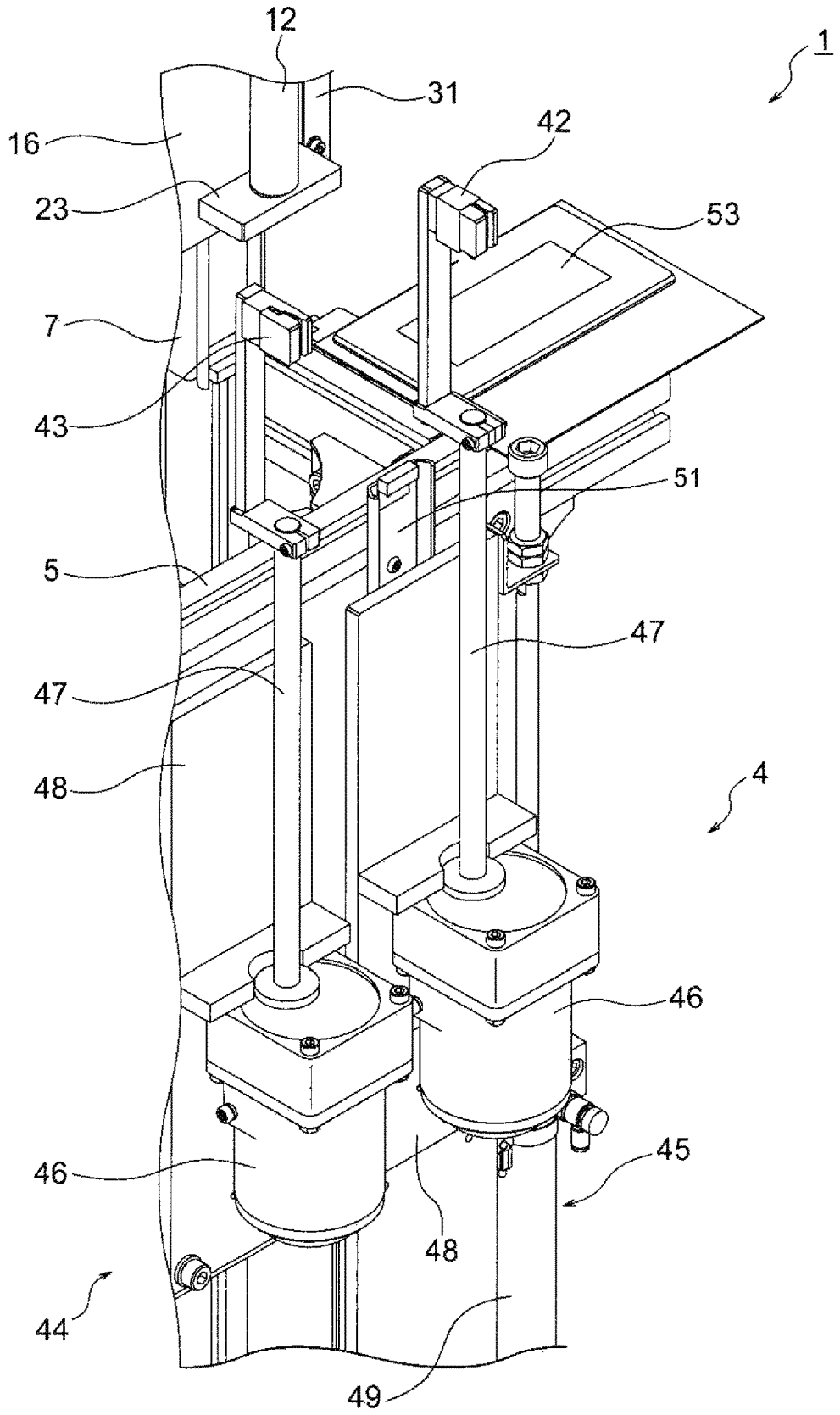
FIG. 5 is an enlarged view of the electric wire twisting unit of FIG. 3.
Figure 6:
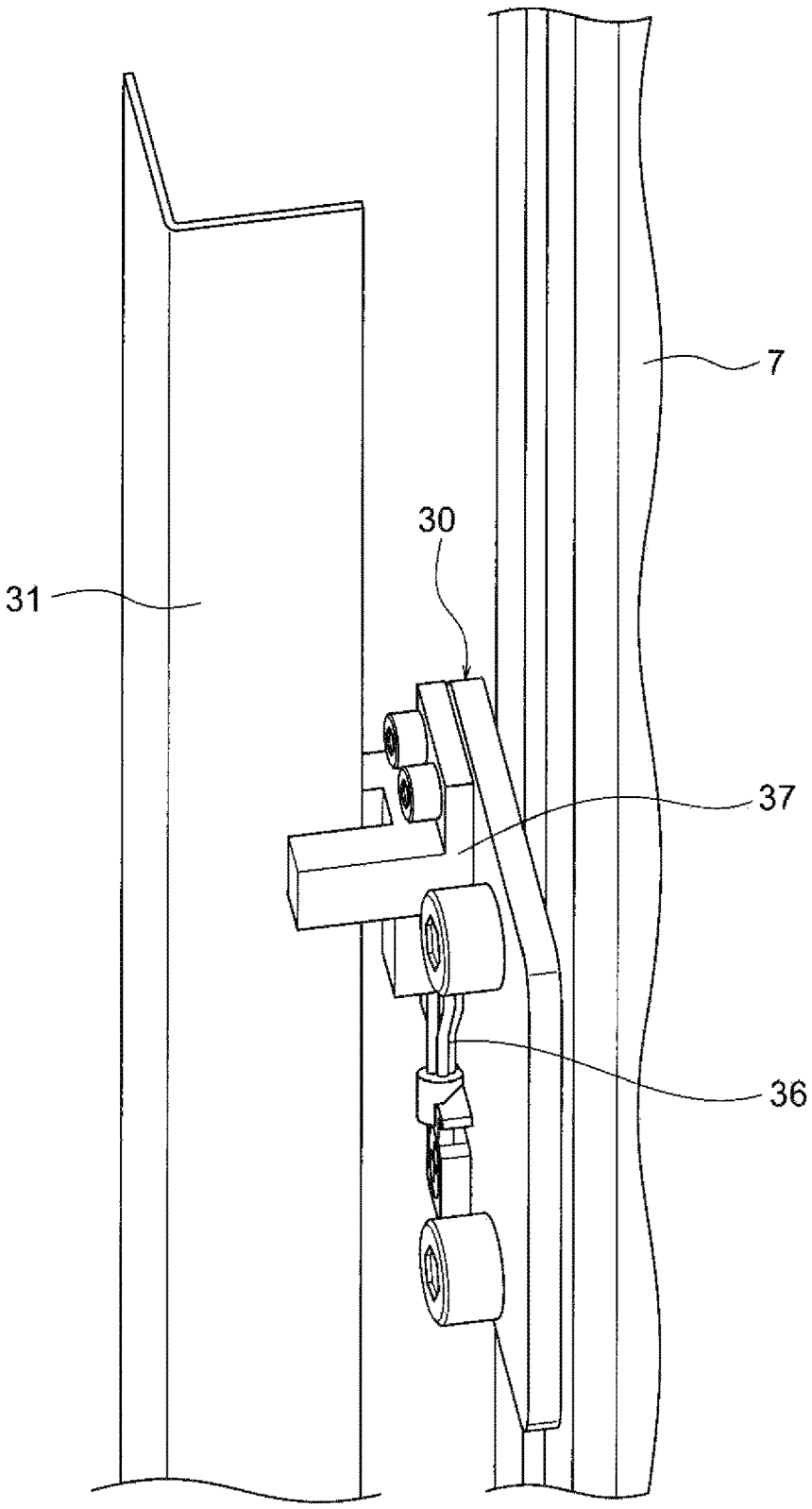
FIG. 6 is an enlarged view of a sensor portion and a light-shielding portion in the electric wire raising/lowering unit of FIG. 1.
Figure 7:
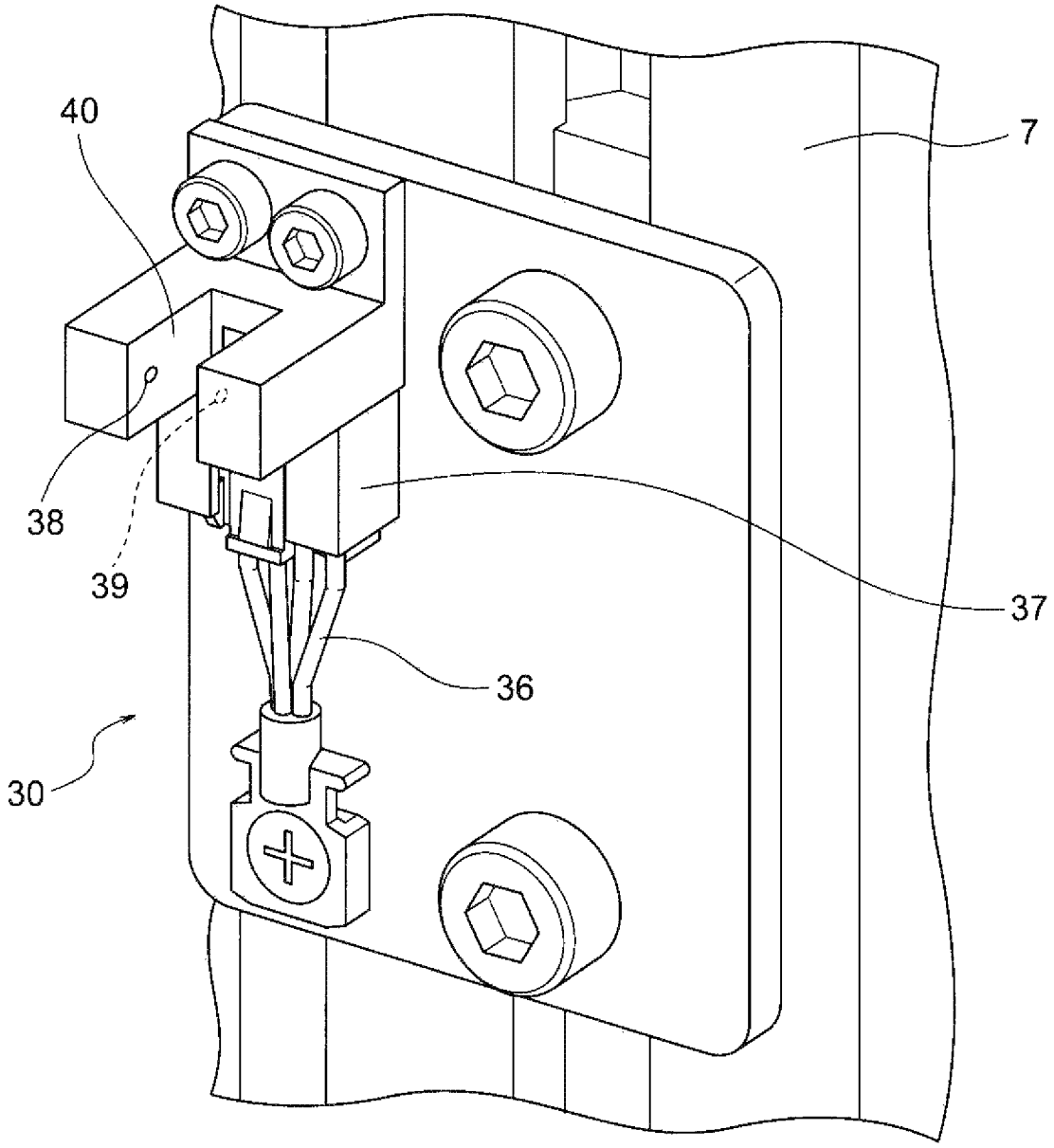
FIG. 7 is a perspective view of the sensor portion of FIG. 6.
Figure 8:
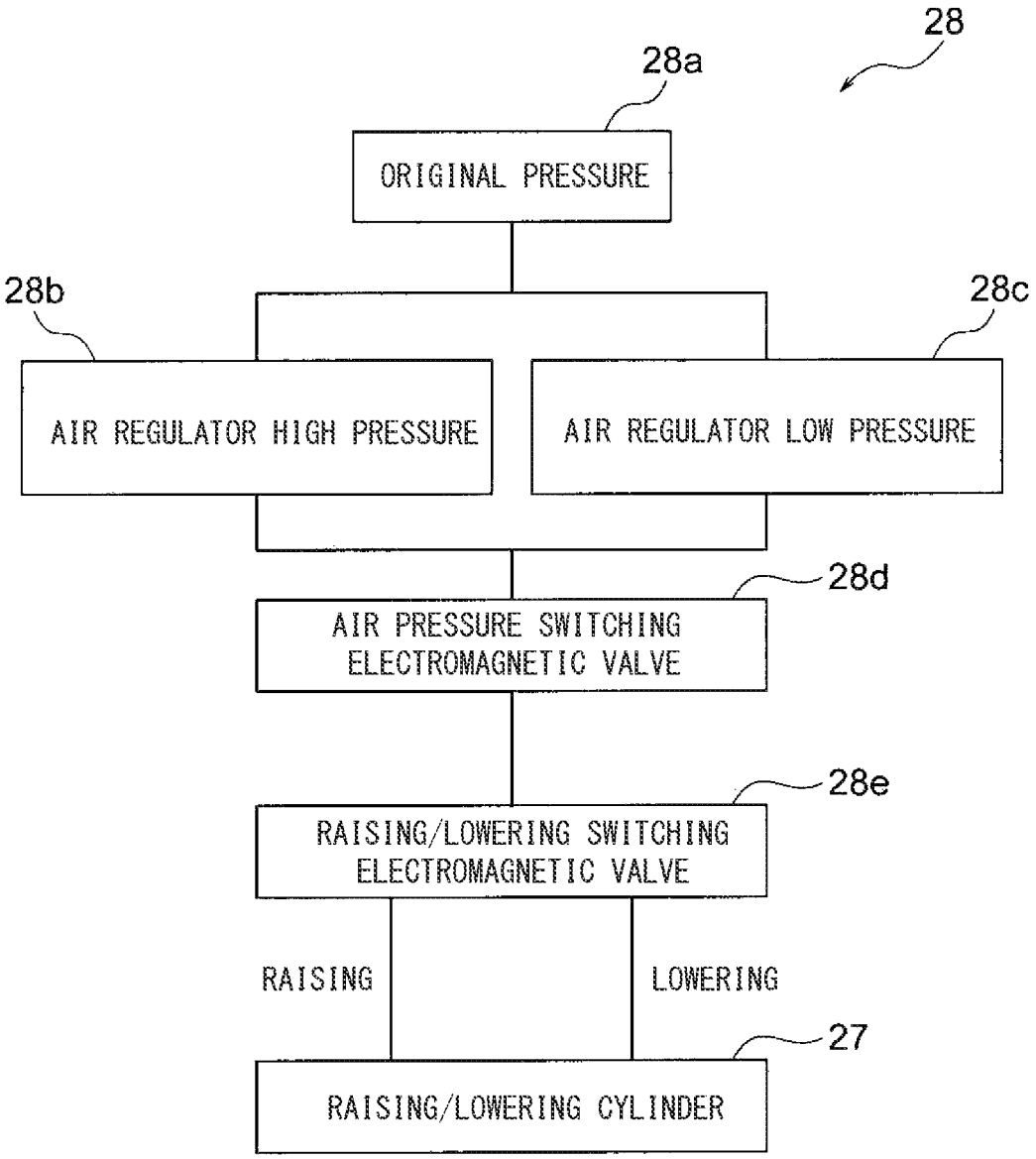
FIG. 8 is an explanatory view of an operation of the electric wire raising/lowering unit of FIG. 1.

Embodiments will be described below with reference to the drawings. FIG. 1 is a perspective view of a twisted wire manufacturing apparatus according to an embodiment of the present invention. FIG. 2 is an enlarged view of a lower portion in the twisted wire manufacturing apparatus of FIG. 1, FIG. 3 is an enlarged view of a main part of FIG. 2, FIG. 4 is an enlarged view of the electric wire raising/lowering unit of FIG. 3, FIG. 5 is an enlarged view of the electric wire twisting unit of FIG. 3, FIG. 6 is an enlarged view of a sensor portion and a light-shielding portion in the electric wire raising/lowering unit of FIG. 1, FIG. 7 is a perspective view of the sensor portion of FIG. 6, and FIG. 8 is an explanatory diagram relating to operation of the electric wire raising/lowering unit of FIG. 1. FIGS. 9A to 15B are explanatory views relating to each step of a twisted wire manufacturing method (in a case of a long twisted wire) according to the embodiment of the present invention. FIGS. 16A to 20B are explanatory views relating to each step of the twisted wire manufacturing method (in a case of a short twisted wire) according to the embodiment of the present invention.

Configuration of Twisted Wire Manufacturing Apparatus 1:

As shown in FIG. 1, the twisted wire manufacturing apparatus 1 is an apparatus for manufacturing a twisted wire 102 (see FIGS. 15A and 15B and 21A and 21B), and includes an electric wire raising/lowering unit 2, an electric wire twisting unit 3, a control unit 4 (specifically, a control portion main body 52 and an operation portion 53) for controlling the entire apparatus, and a frame 5 for installing these units at predetermined positions. Each configuration will be described below.

Figure 15A:
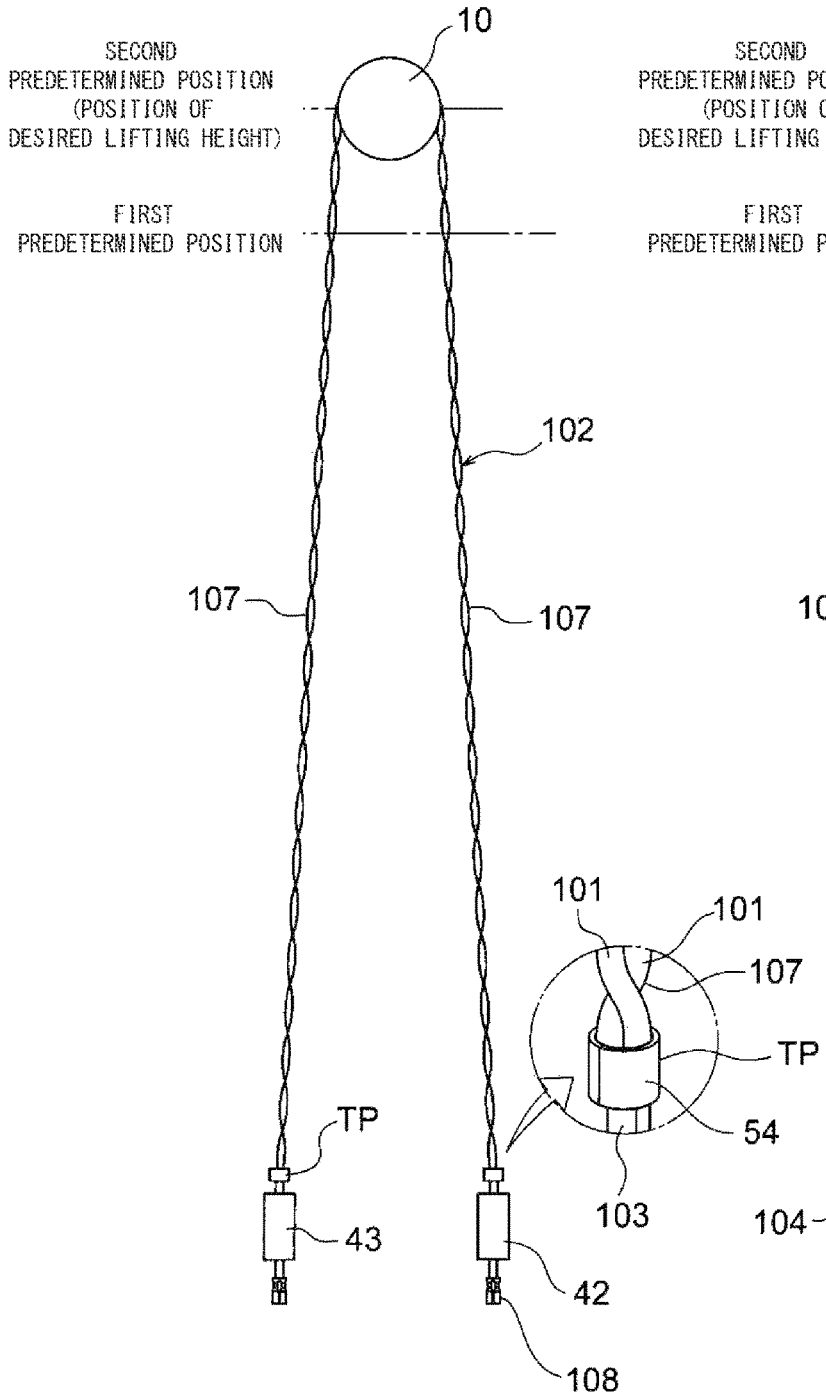
FIGS. 15A and 15B are explanatory views of a tape winding step and a detachment step of the twisted wire manufacturing method according to the embodiment of the present invention.
Figure 15B:
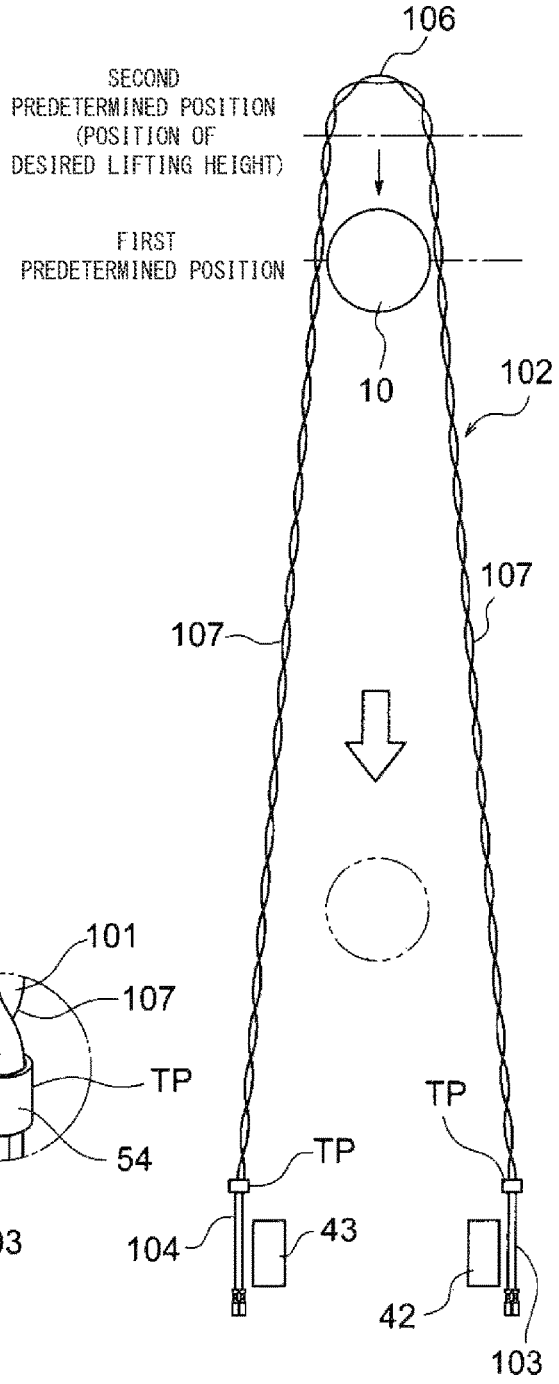
Figure 21A:
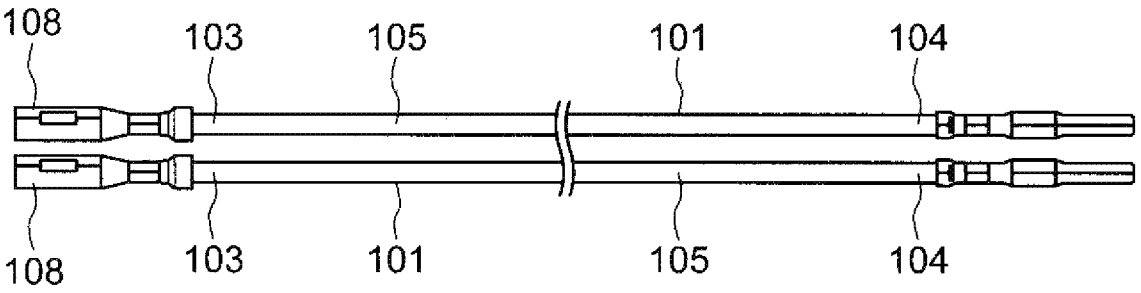
FIG.21A Prior Art
FIGS. 21A and 21B are diagrams illustrating a conventional example, where
Figure 21B:
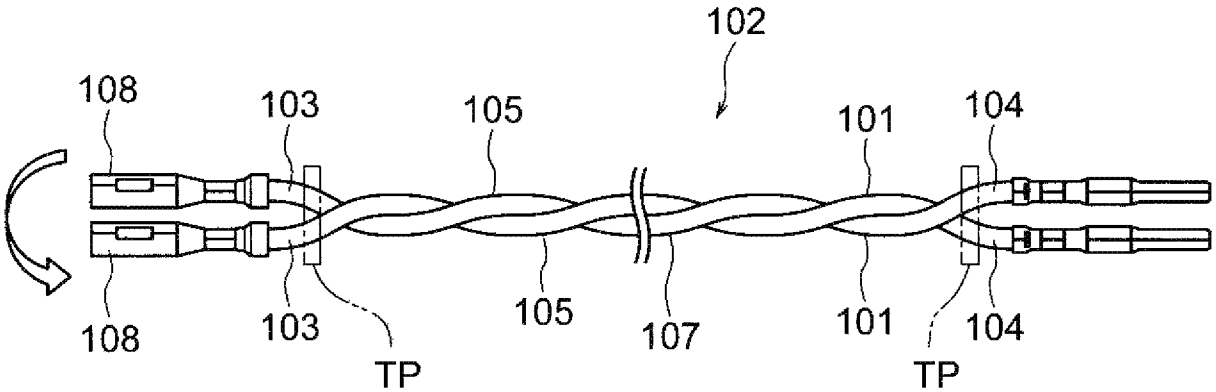
FIG.21B Prior Art

Twisted Wire 102:

As shown in FIGS. 15A and 15B, the twisted wire 102 has the same configuration and structure as the twisted wire 102 shown in FIGS. 21A and 21B (conventional example), and is manufactured by twisting two electric wires 101. The twisted wire 102 of the present embodiment includes two electric wires 101, but may have a larger number. Specifically, for example, the twisted wire 102 may have four electric wires, four electric wires in total having different thicknesses, etc.

Electric Wire Raising/Lowering Unit 2:

As shown in FIGS. 1 to 4, the electric wire raising/lowering unit 2 is a unit for lifting the two electric wires 101 (see FIGS. 15A and 15B) and lowering the manufactured twisted wire 102 (see FIGS. 15A and 15B). The electric wire raising/lowering unit 2 includes a raising/lowering portion 6 which is a portion for raising the two electric wires 101, a raising/lowering guidance portion 7 for guiding the raising/lowering portion 6 in a vertical direction, and a high-speed/low-speed raising/lowering mechanism 8 for lifting the raising/lowering portion 6 at a high speed or a low speed.

Raising/Lowering Portion 6:

As shown in FIGS. 3 and 4, the raising/lowering portion 6 includes a raising/lowering portion main body 9, an electric wire hanging portion 10 provided on the raising/lowering portion main body 9, an electric wire pressing portion 11 provided on the raising/lowering portion main body 9, and a tension application portion 12. In addition, the raising/lowering portion 6 of the present embodiment includes a pair of optional chuck portions 13 and a pair of electric wire guards 14 provided on the raising/lowering portion main body 9.

Raising/Lowering Portion Main Body 9:

As shown in FIG. 3, the raising/lowering portion main body 9 of the present embodiment is composed of an upper member and a lower member, and is specifically composed of an upper main body 15 and a lower main body 16. The upper main body 15 and the lower main body 16 are connected to each other via the tension application portion 12. As will be described later, the tension application portion 12 is a member having elasticity in the vertical direction (if elasticity is not required, the raising/lowering portion main body 9 does not have to be divided into the above two). The upper main body 15 and the lower main body 16 are formed so that the lower main body 16 is raised and lowered by the high-speed/low-speed raising/lowering mechanism 8, which will be described later, and are formed so that in accordance with such raising and lowering, the upper main body 15 is also guided in the vertical direction by the raising/lowering guidance portion 7, which will be described later.

Upper Main Body 15:

As shown in FIG. 4, the upper main body 15 is formed into a substantially cylindrical shape including a front wall 17, a left side wall 18, a right side wall 19, and a rear wall 20. A front surface of the front wall 17 is provided with the electric wire hanging portion 10 and the electric wire pressing portion 11. The front wall 17 is formed in a left-right asymmetric shape so that a right side thereof further extends in a right direction. A strip-shaped portion protruding downward is formed on an extending part on the right side. An optional chuck portion 13 and an electric wire guard 14, which are on the right side of a pair, are provided on the strip-shaped portion.

The left side wall 18 and the right side wall 19 are fixed to a rear surface of the front wall 17 at a predetermined interval. A light-shielding piece 32, which will be described later, is provided at a lower portion of the left side wall 18. The light-shielding piece 32 is disposed corresponding to a position of a pair of sensor portions 33, which will be described later. The light-shielding piece 32 and the sensor portions 33 are provided as one configuration of the high-speed/low-speed raising/lowering mechanism 8, which will be described later, in order to detect the degree of tension applied when the two electric wires 101 are lifted (see FIGS. 11A and 11B).

The rear wall 20 is fixed to the left side wall 18 and the right side wall 19. The rear wall 20 is provided with a guidance protrusion 21, which is inserted into a guidance recess 25 of the raising/lowering guidance portion 7, which will be described later, and which is guided in the vertical direction. The guidance protrusion 21 is formed into a convex part.

Figure 9A:
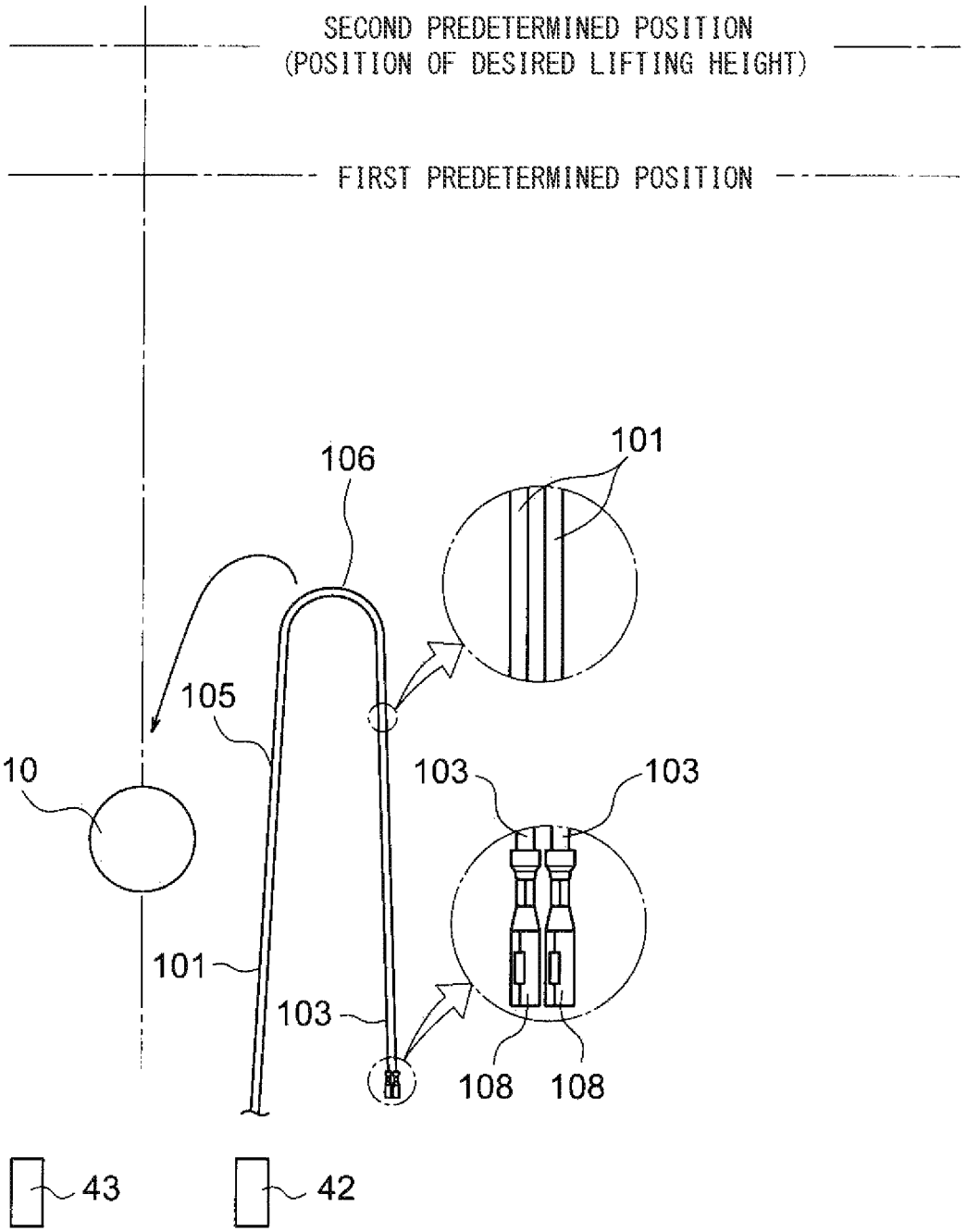
FIGS. 9A and 9B are explanatory views of an electric wire intermediate raising step of a twisted wire manufacturing method (in a case of a long twisted wire) according to the embodiment of the present invention.
Figure 9B:
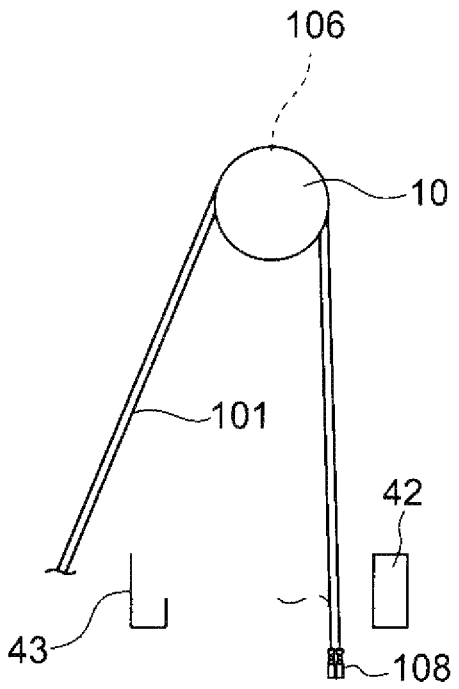

Electric Wire Hanging Portion 10:

As shown in FIGS. 4 and 9B, the electric wire hanging portion 10 is formed as a portion for hanging respective intermediate portions 106 (a portion curved in a U shape) generated at middles 105 of the two electric wires 101. In the present embodiment, the electric wire hanging portion 10 is formed in a circular roller shape, and is formed to be rotatable. The recess 22 is formed in one round on the electric wire hanging portion 10. The recess 22 is formed as a portion for preventing the intermediate portion 106 from falling off.

Electric Wire Pressing Portion 11:

As shown in FIG. 4, the electric wire pressing portion 11 is hanged such that the above-described respective intermediate portions 106 (see FIGS. 9A and 9B) do not intersect the recess 22 of the electric wire hanging portions 10, and then is provided as a portion for pressing the respective intermediate portions 106 (see FIGS. 9A and 9B) from above, and as a portion covering the recess 22. The electric wire pressing portion 11 is provided as a portion for preventing the electric wires from falling off or loosing upon lifting.

Lower Main Body 16:

As shown in FIGS. 3 and 4, the lower main body 16 is formed into a flat plate-like part. A left upper part of the lower main body 16 is connected to a connecting arm 29 of the high-speed/low-speed raising/lowering mechanism 8, which will be described later. The lower main body 16 is formed so as to be raised and lowered by the connecting arm 29. The lower main body 16 is guided in the vertical direction along the raising/lowering guidance portion 7, which will be described later. The lower main body 16 is provided with a mounting portion 23, a light-shielding portion 31, which will be described later, an optional chuck portion 13 on the left side of the pair, and an electric wire guard 14 which is also on the left side. The light-shielding portion 31 is disposed at a position corresponding to sensor portions 30, which will be described later. The light-shielding portion 31 and the sensor portions 30 are provided as a configuration of the high-speed/low-speed raising/lowering mechanism 8, which will be described later.

Mounting Portion 23:

As shown in FIG. 3, the mounting portion 23 is formed into a piece-like portion which is horizontally long and protrudes forward. The mounting portion 23 is formed such that an upper surface thereof is capable of mounting and fixing a lower end side of the tension application portion 12.

Tension Application Portion 12:

As shown in FIGS. 3 and 4, the tension application portion 12 is a member having a spring compressed downward when applied a load, which is formed with a lower end side fixed to the mounting portion 23, and an upper end assembled to the upper main body 15.

A Pair of Optional Chuck Portions 13:

As shown in FIGS. 3 and 4, the pair of optional chuck portions 13 are used when twisting a plurality of short electric wires (not shown). The pair of optional chuck portions 13 are formed into a shape such that an upper end of the short electric wires can be chucked. The pair of optional chuck portions 13 are disposed immediately above a one-end chuck portion 42 and an other-end chuck portion 43 of the electric wire twisting unit 3, which will be described later. The pair of optional chuck portions 13 are disposed at positions where the short electric wires can be lifted straight upward (without being bent in a U shape).

The pair of optional chuck portions 13 may be not provided as long as in an apparatus that does not require twisting of the short electric wires (similarly, the pair of electric wire guards 14 described below may be not provided as well).

A Pair of Electric Wire Guards 14:

As shown in FIGS. 3 and 4, the pair of electric wire guards 14 are provided to prevent the two electric wires 101 (see FIGS. 9A to 15B) from coming into contact with the pair of optional chuck portions 13 at the time of manufacturing the twisted wire 102 (see FIGS. 15A and 15B).

Raising/Lowering Guidance Portion 7:

As shown in FIGS. 1 to 6, the raising/lowering guidance portion 7 is a rod-shaped member extending straight in the vertical direction, and a lower end side thereof has a fixed portion with respect to the frame 5 formed thereon. The raising/lowering guidance portion 7 is formed to have a height dimension of at least a half or more with respect to an entire length of the twisted wire 102 to be manufactured (see FIGS. 15A and 15B). The raising/lowering guidance portion 7 is formed so as to be able to guide (so as to be able to raise and lower) the upper main body 15 in the vertical direction, and is specifically formed in an illustrated shape having the concave (groove-shaped) guidance recess 25. The guide recess 25 is disposed and formed on a front surface of the raising/lowering guidance portion 7.

The sensor portions 30, which will be described later, are provided on a right side surface of the raising/lowering guidance portion 7. The sensor portions 30 are disposed at a plurality of positions at predetermined intervals in order to detect raised and lowered positions of the raising/lowering portion 6.

High-Speed/Low-Speed Raising/Lowering Mechanism 8:

As shown in FIGS. 1 to 4, the high-speed/low-speed raising/lowering mechanism 8 is provided on the twisted wire manufacturing apparatus 1 for lifting the raising/lowering portion 6 at a high speed or a low speed as described above. The twisted wire manufacturing apparatus 1 is provided with the high-speed/low-speed raising/lowering mechanism 8, and thus is characterized in not having a configuration only simply lifting the two electric wires 101 (see FIGS. 9A to 15B). The high-speed/low-speed raising/lowering mechanism 8 is controlled by the control unit 4, which will be described later.

The high-speed/low-speed raising/lowering mechanism 8 of the present embodiment is configured to be able to lift using an air cylinder (not limited thereto, and may be configured to lift with a motor or the like; used in the present embodiment so as to lower the cost), and is specifically provided with a raising/lowering cylinder 27, an air supply apparatus 28 for supplying air to the raising/lowering cylinder 27, a connecting arm 29 between the raising/lowering cylinder 27 and the raising/lowering portion 6, the sensor portions 30 provided at a plurality of positions of the raising/lowering guidance portion 7, the light-shielding portion 31 provided on the raising/lowering portion 6, the light-shielding unit 32 provided on the raising/lowering portion 6, and the sensor portions 33 provided on the connecting arm 29.

Raising/Lowering Cylinder 27:

As shown in FIGS. 1 to 4, the raising/lowering cylinder 27 is a known air cylinder, and has a length necessary for manufacturing the twisted wire 102 (see FIGS. 15A and 15B). In the present embodiment, a long one is adopted, and is disposed in the illustrated state so as to extend in the vertical direction parallel to the raising/lowering guidance portion 7.

Air Supply Apparatus 28:

As shown in FIGS. 1 and 2, the air supply apparatus 28 is disposed in a box 34 fixed to the frame 5 (as one example). The air supply apparatus 28 includes, for example, a plurality of parts as shown in FIG. 8.

As shown in FIG. 8, specifically, the air supply apparatus 28 is composed of an original pressure generating portion 28*a* for generating an "original pressure", a high-pressure air regulator portion 28*b* connected to the original pressure generating portion 28*a* and functioning as a "high-pressure air regulator", a low-pressure air regulator portion 28*c* connected to the original pressure generating portion 28*a* and functioning as a "low-pressure air regulator", an air pressure switching electromagnetic valve portion 28*d* connected to the high-pressure air regulator portion 28*b* and the low-pressure air regulator portion 28*c* and functioning as an "air pressure switching electromagnetic valve", and a raising/lowering switching electromagnetic valve portion 28*e* connected to the air pressure switching electromagnetic valve portion 28*d* and functioning as an "raising/lowering switching electromagnetic valve". That is, the air supply apparatus 28 is configured to be able to raise and lower the raising/lowering cylinder 27 by high-pressure air or low-pressure air.

A power supply apparatus 35 for power supply, the control portion main body 52 of the control unit 4, which will be described later, and the like are also provided in the box 34 in which the air supply apparatus 28 is disposed as described above (as one example).

Connecting Arm 29:

As shown in FIGS. 3 and 4, the connecting arm 29 is an L-shaped strip plate member, and one end thereof is fixed to an extendable portion of the raising/lowering cylinder 27. The other end thereof is fixed to the lower main body 16 of the raising/lowering portion 6. The connecting arm 29 is formed so as to be able to raise and lower the lower main body 16 in accordance with extension and compression (vertical movement) of the raising/lowering cylinder 27.

When the lower main body 16 is raised or lowered, the upper main body 15 is raised or lowered as well, and accordingly, the electric wire hanging portion 10 provided on the upper main body 15 is raised or lowered as well. Since the electric wire hanging portion 10 is a portion for hanging the respective intermediate portions 106 (see FIGS. 9A and 9B) generated on the two electric wires 101 (see FIGS. 9A and 9B), the two electric wires 101 are lifted when the connecting arm 29 is raised.

Sensor Portions 30:

As shown in FIG. 1, the sensor portions 30 are provided at a plurality of positions on the right side surface of the raising/lowering guidance portion 7 at predetermined intervals. The sensor portions 30 are provided to detect the position of the raising/lowering portion 6.

As shown in FIGS. 6 and 7, each of the sensor portions 30 is provided with a sensor main body 37 connected to the control unit 4 (see FIG. 2), which will be described later, via a signal wire 36. The sensor main body 37 is provided with a light emission portion 38 for emitting light and a light receipt portion 39 for receiving light from the light emission portion 38. A space 40 through which the light-shielding portion 31 passes is formed between the light emission portion 38 and the light receipt portion 39. As the sensor portion 30 of the present embodiment, a known photo sensor is adopted.

Light-Shielding Portion 31:

As shown in FIGS. 4 and 6, the light-shielding portion 31 is provided to detect the position of the raising/lowering portion 6 similarly to the sensor portions 30. The light-shielding portion 31 is formed into a plate-like part capable of shielding light from the light emission portion 38 in the sensor portions 30. The light-shielding portion 31 is disposed so as to pass through the space 40 of the sensor main body 37 when raising and lowering of the raising/lowering portion 6.

Light-Shielding Piece 32:

As shown in FIG. 4, the light-shielding piece 32 is disposed on a lower part of the left side wall 18 of the upper main body 15 of the raising/lowering portion 6. The light-shielding piece 32 is provided to detect the position of the upper main body 15 in a state of being urged by the tension applying unit 12. When the light-shielding piece 32 is positioned between the pair of upper and lower sensor portions 33, it is determined in the present embodiment that a proper tension is applied to the two electric wires 101 (see FIGS. 9A to 15B).

Sensor Portions 33:

As shown in FIG. 4, the sensor portions 33 are disposed on the connecting arm 29 via an attachment portion 41. Further, the sensor portions 33 are disposed so as to be an upper-lower pair at a predetermined interval. Each of the pair of sensor portions 33 is provided with a light emission portion for emitting light and a light receipt portion for receiving light from the light emission portion. Moreover, a space through which the light-shielding piece 32 passes is formed. A known photosensor is employed as the sensor portions 33 of the present embodiment.

Electric Wire Twisting Unit 3:

As shown in FIGS. 1 to 3, the electric wire twisting unit 3 is provided together with the electric wire raising/lowering unit 2 for chucking and twisting with respect to the two electric wires 101 (see FIGS. 9A to 15B). The electric wire twisting unit 3 includes the one-end chuck portion 42, the other-end chuck portion 43, a co-rotation portion 44, and a chuck vertical position-changing mechanism 45.

One-End Chuck Portion 42 and Other-End Chuck Portion 43:

As shown in FIGS. 3 and 5, the one-end chuck portion 42 is configured to be able to detachably chuck one end 103 of the two electric wires 101 (see FIGS. 9A to 15B). Similarly, the other-end chuck portion 43 is configured to be able to detachably chuck the other end 104 of the two electric wires 101.

Co-Rotation Portion 44:

As shown in FIGS. 3 and 5, the co-rotation portion 44 is configured to be able to rotate the one-end chuck portion 42 and the other-end chuck portion 43 in the same direction at different timings. The different timings mean that the rotation is not synchronizing, for example, the one-end chuck portion 42 is rotated after the other-end chuck portion 43 is rotated first and stopped. The co-rotation portion 44 includes a pair of motors 46 controlled by the control unit 4, which will be described later, a pair of rotation shafts 47 respectively rotated by the pair of motors 46, and a pair of motor fixing portions 48 for fixing the pair of motors 46, respectively. One on the left side of the pair of motor fixing portions 48 is fixed in a stationary state, and one on the right side is fixed to the chuck vertical position-changing mechanism 45 so as to be movable in the vertical direction.

Chuck Vertical Position-Changing Mechanism 45:

As shown in FIGS. 3 and 5, the chuck vertical position-changing mechanism 45 is configured to be able to change the positions of the first chuck portion 42 and the other-end chuck portion 43 in the vertical direction. In this embodiment, a configuration is adopted such that the motor 46 on the right side moves downward, thereby changing the two positions in the vertical direction. Toe describe the configuration and structure more specifically, the chuck vertical position-changing mechanism 45 includes a lowering cylinder 49, an air supply apparatus 50 for supplying air to the lowering cylinder 49, a slider rail 51 extending in the vertical direction, and a guidance protrusion (not shown) provided on the motor fixing portion 48 on the right side and guided by the slider rail 51. The air supply apparatus 50 is disposed in the box 34 (as one example). The slider rail 51 is fixed to the frame 5. The chuck vertical position-changing mechanism 45 is controlled by a control unit 4, which will be described later.

Control Unit 4:

As shown in FIGS. 1 and 2, the control unit 4 is provided for controlling operation of the electric wire raising/lowering unit 2 and the electric wire twisting unit 3. The control unit 4 is composed of the control portion main body 52 disposed in the box 34 (as one example), and the operation portion 53 fixed to, for example, the right side of the frame 5 and operated by an operator. The control portion main body 52 includes a known PLC or the like. The operation portion 53 is configured to be operable by, for example, a touch panel. The storage unit of the control portion main body 52 stores various data and the like necessary for manufacturing the twisted wire 102 (see FIGS. 15A and 15B). As the operation portion 53, one capable of inputting numerical values is employed.

Method for Manufacturing Long Twisted Wire 102:

The manufacturing process adopted in the twisted wire manufacturing apparatus 1 as described above includes an electric wire intermediate raising step, an electric wire one-end chuck step, a first electric wire lifting step, a second electric wire lifting step, an electric wire other-end chuck step, an electric wire twisting step, a tape winding step, and a detachment step (the steps here are one example because they are slightly different from the manufacturing method of the short twisted wire 102, which will be described later).

Hereinafter, each step will be described with reference to FIGS. 9A to 15B (see also FIGS. 1 to 8 as necessary). It is assumed that the apparatus is operated by operation of the operation portion 53 by the operator, and the details of operation are omitted here.

Electric Wire Intermediate Hanging Step:

As shown in FIGS. 9A and 9B, in the electric wire intermediate raising step, the two long electric wires 101 are taken out from a component shelf (electric wire stock shelf) in the vicinity of the operator, and the respective intermediate portions 106 of the two electric wires 101 are hanged on the electric wire hanging portion 10.

In the operation to be applied to the electric wire hanging portion 10, since the two electric wires 101 are long, the intermediate portions 106 are not formed at central positions thereof, but are formed to be bent into a U shape on the side close to the one end 103.

It is assumed that the two electric wires 101 are hanged so that the intermediate portions 106 do not intersect (do not overlap each other vertically) at the electric wire hanging portion 10. This is because that if the intermediate portions 106 cross each other (the electric wire crossing state), a twist pitch (electric wire pitch) changes when twisting.

After the intermediate portions 106 are hanged to the electric wire hanging portion 10, the electric wire pressing portion 11 presses the intermediate portions 106 (the electric wire pressing portion 11 has a hinge part, and the intermediate portions 106 can be pressed from above by tilting the electric wire pressing portion 11 from the L shape to a horizontal state).

A center line in the vertical direction of the paper in FIGS. 9A and 9B indicates an axis for raising (lifting) and lowering the electric wire hanging part 10, and also schematically shows the raising/lowering guidance portion 7. In addition, a center line in the lateral direction of the paper indicates a position corresponding to the above-described "first predetermined position" and "second predetermined position (position of desired lifting height)". These positions will be described in the following steps. The position of the electric wire hanging portion 10 shown in FIGS. 9A and 9B is defined as an "initial position" in the present embodiment.

Figure 10A:
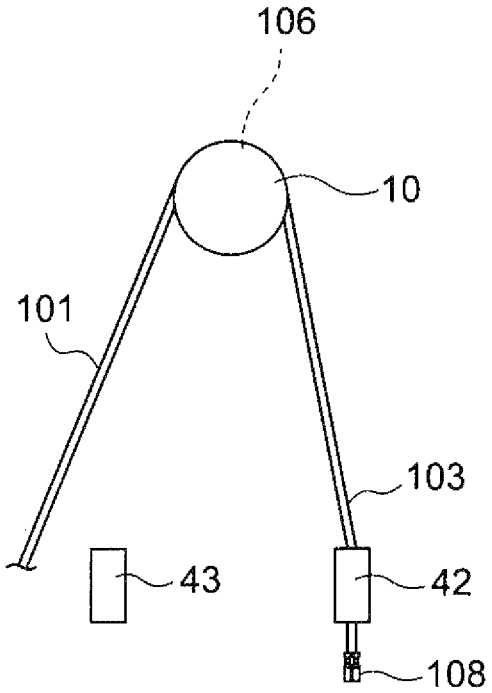
FIGS. 10A and 10B are explanatory views of an electric wire one-end chuck step and a first electric wire lifting step of the twisted wire manufacturing method according to the embodiment of the present invention.

Electric Wire One-End Chuck Step:

As shown in FIG. 10A, in the electric wire one-end chuck step, the one end 103 of the two electric wires 101 is chucked by the one-end chuck portion 42. A range from the chuck position to a terminal fitting 108 is not subjected to twisting, which will be described later.

Figure 10B:
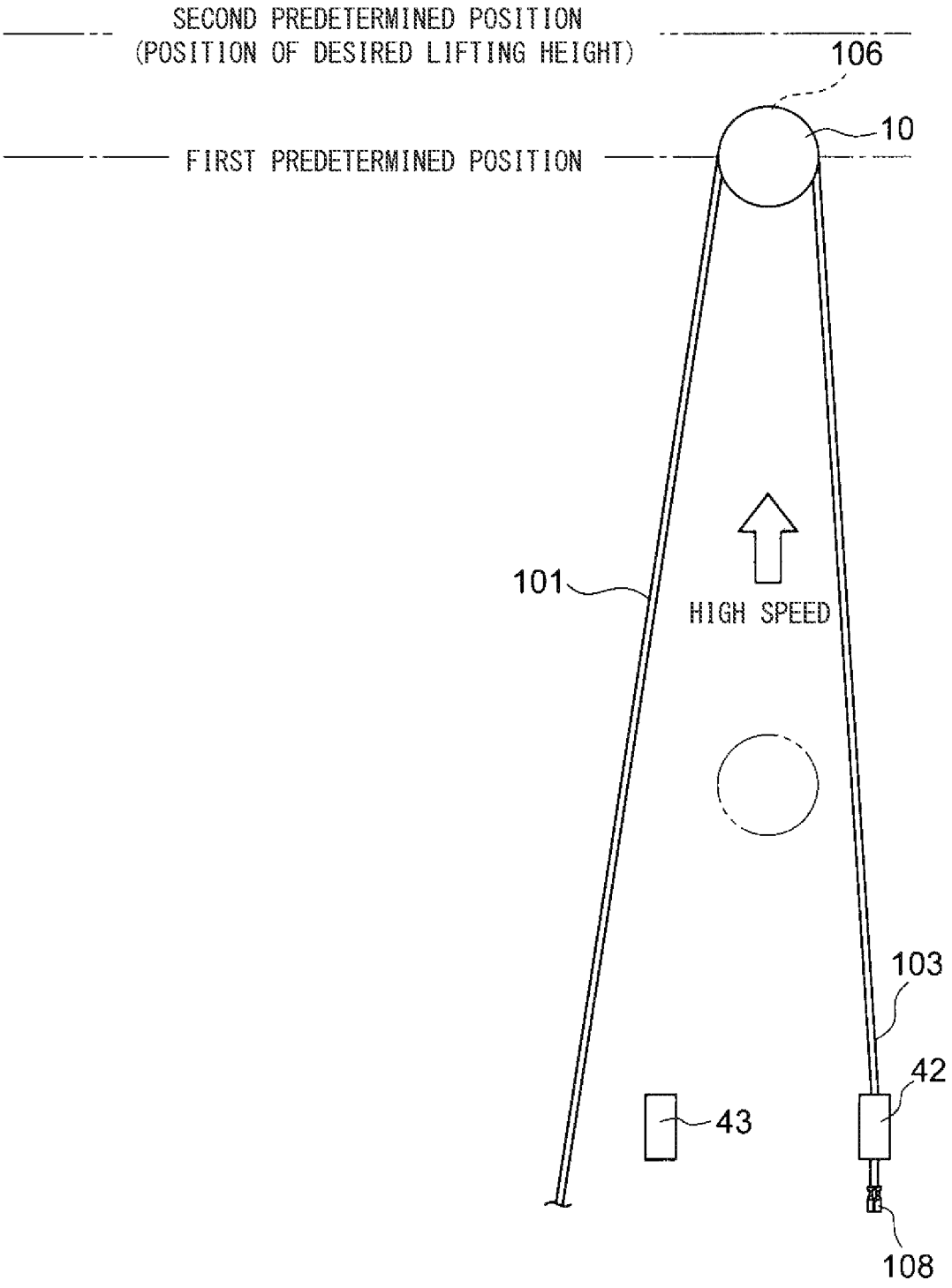

First Electric Wire Lifting Step:

As shown in FIGS. 10A and 10B, in the first electric wire lifting step, when the high-speed/low-speed raising/lowering mechanism 8 is operated to raise the position of the electric wire hanging portion 10 from the "initial position" to the upper "first predetermined position" at once (in a case of the long electric wires 101, when raised slowly, more time is cost accordingly, and thus the time can be shortened by raising in a short time, i.e., at a high speed). When raising at a high speed, the air pressure switching electromagnetic valve portion **28*d* is set to high air pressure through control (command) of the control portion main body 52. Further, the raising/lowering switching electromagnetic valve portion 28*e* is set to raising. As a result, the electric wire hanging portion 10 starts being raised. That is, the two electric wires 101** starts being lifted.

In the first electric wire lifting step, the position of the intermediate portion 106 changes with raising of the electric wire hanging portion 10. When the operator performs an operation such that the operator reaches his/her hand to the electric wire part on the left side to the intermediate portions 106 (the electric wire part on the other end 104 side), fluttering of the two electric wires 101 due to raising can be prevented.

When the electric wire hanging part 10 reaches the "first predetermined position", the electric wire hanging part 10 is raised close to (immediately before) the desired lifting height (the "first predetermined position" refers to the position close to the desired lifting height, and is also a position of the sensor portion 30 at substantially a center of the raising/lowering guidance portion 7 in this embodiment).

Figure 11A:
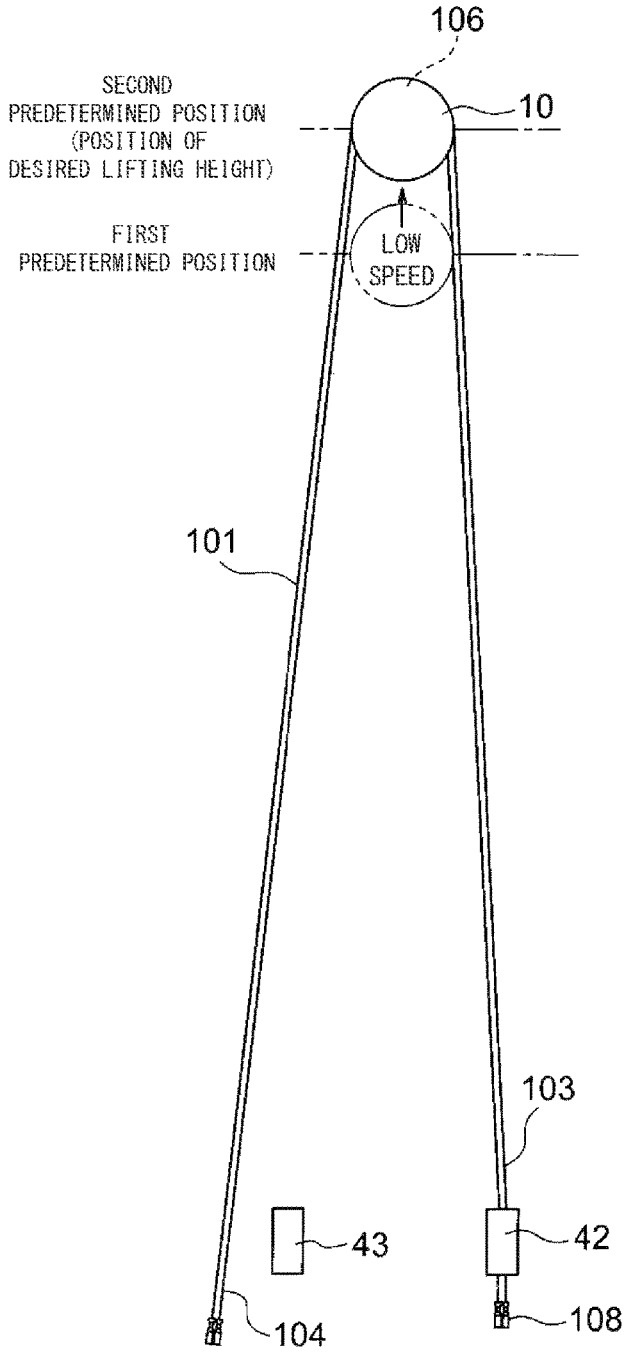
FIGS. 11A and 11B are explanatory views of a second electric wire lifting step and an electric wire other-end chuck step of the twisted wire manufacturing method according to the embodiment of the present invention.

Second Electric Wire Lifting Step:

As shown in FIGS. 10B and 11A, in the second electric wire lifting step, the high-speed/low-speed raising/lowering mechanism 8 is operated to slowly raise the position of the electric wire hanging portion 10 from the "first predetermined position" to the slightly upper "second predetermined position (position of the desired lifting height)" (the tension is not abruptly applied if raised slowly at a low speed). With respect to raising at a low speed, one of the sensor portions 30 is disposed corresponding to the "first predetermined position", and a signal is sent to the control portion main body 52 when the light-shielding portion 31 passes through this sensor portion 30. When the air pressure switching electromagnetic valve portion 28*d* is switched to low air pressure through control (command) of the control portion main body 52, the electric wire hanging portion 10 starts being raised at a low speed, that is, switched such that the two electric wires 101 are raised through the remaining slight distance to the "position of the desired lifting height".

As shown in FIG. 11A, when the electric wire hanging portion 10 reaches the "second predetermined position", the electric wire hanging portion 10 is raised to the position of the desired lifting height. The present embodiment adopts a control method in which, when a signal is sent from the sensor portion 30 to the control portion main body 52 at the "first predetermined position", a timer in the control portion main body 52 functions, and after the electric wire hanging portion 10 is raised slowly for a predetermined time (several seconds), the electric wire hanging portion 10 is stopped exactly at the desired lifting height position (the control method is one example).

Figure 11B:
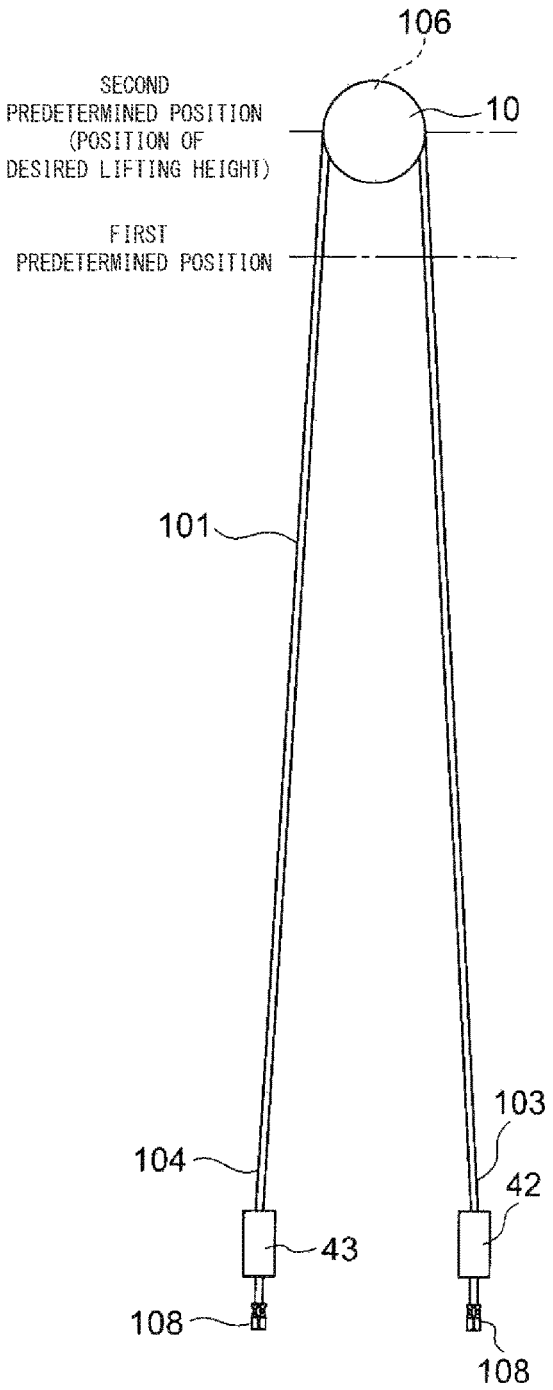

Electric Wire Other-End Chuck Step:

As shown in FIG. 11B, in the electric wire other-end chuck step, the other end 104 of the two electric wires 101 is chucked by the other-end chuck portion 43.

Figure 12A:
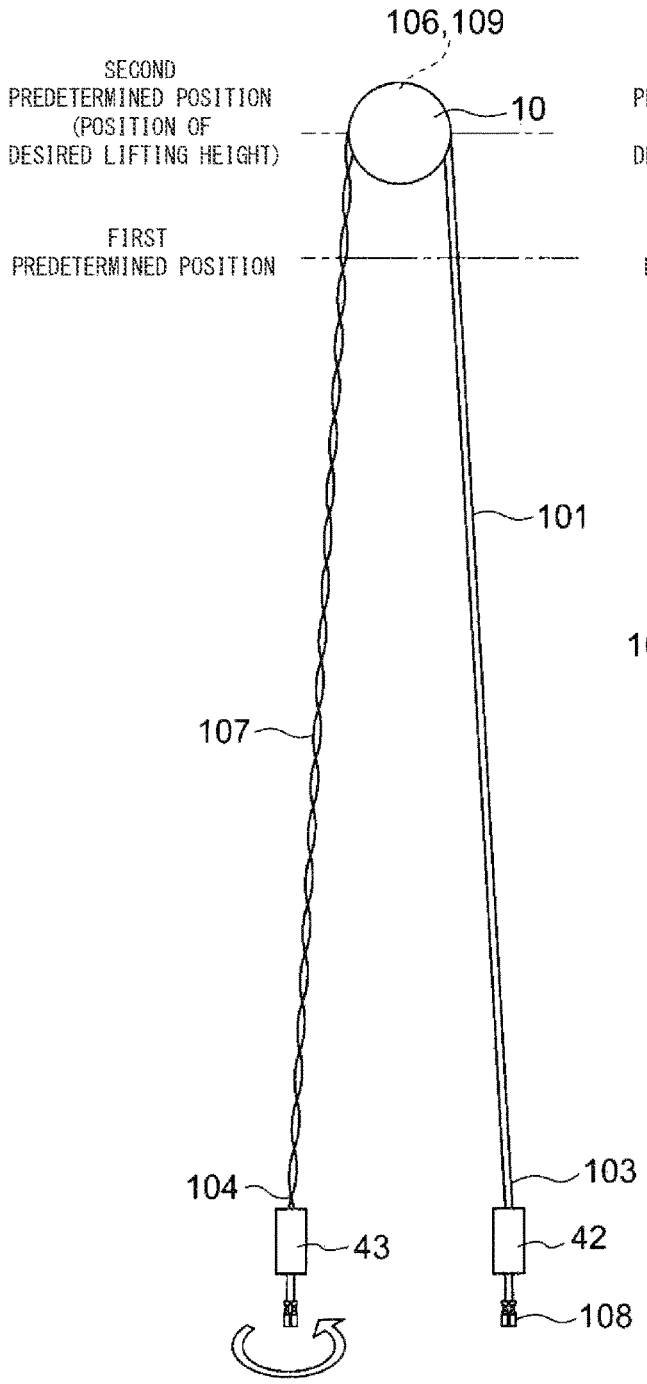
FIGS. 12A and 12B are explanatory views of an electric wire twisting step (twisting on the other end side) of the twisted wire manufacturing method according to the embodiment of the present invention.

Electric Wire Twisting Step:

As shown in FIG. 12A, in the electric wire twisting step, the following first to sixth steps are performed in order.

Figure 12B:
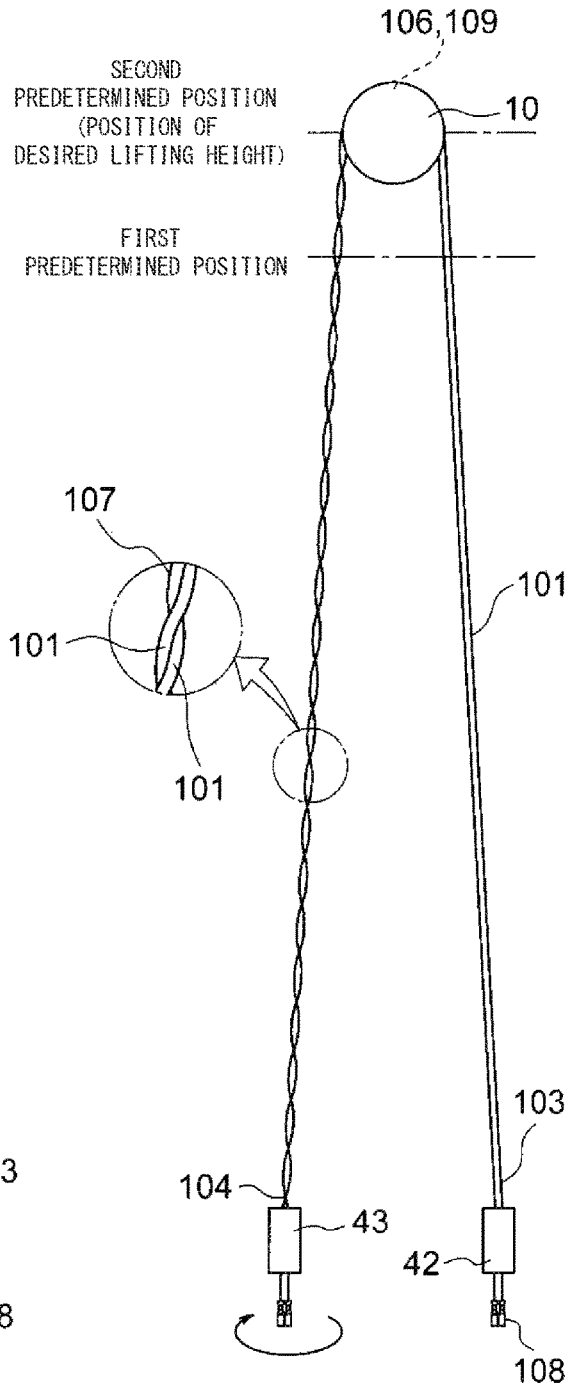
Figure 13A:
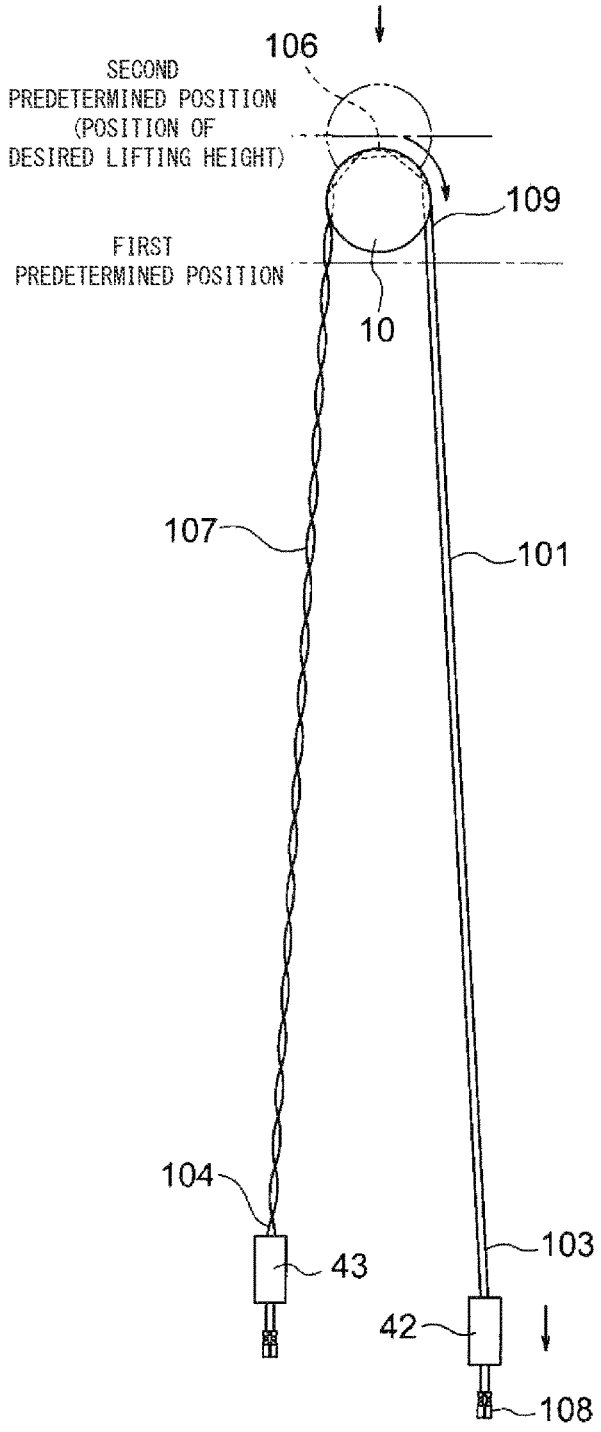
FIGS. 13A and 13B are explanatory views of the electric wire twisting step (twisting to a non-twisted portion) of the twisted wire manufacturing method according to the embodiment of the present invention.

First, in the first step, the other-end chuck portion 43 is rotated by the co-rotation portion 44 on the left side, for example, in a direction of the arrow. Next, in the second step, as shown in FIG. 12B, the other-end chuck portion 43 is rotated only a few times in a direction opposite to the above (so-called twisting back is performed). Through these two steps, a twisted portion 107 is formed on the left side of the electric wire hanging portion 10. Next, in the third step, as shown in FIG. 13A, the chuck vertical position-changing mechanism 45 is operated to change the positions of the electric wire hanging portion 10 and the one-end chuck portion 42 slightly downward. At this time, the position of the intermediate portion 106 hanged to the electric wire hanging portion 10 is displaced. In other words, a position of an untwisting portion 109, which may be not twisted due to the contact with the electric wire hanging portion 10, is shifted in a clockwise direction.

Figure 13B:
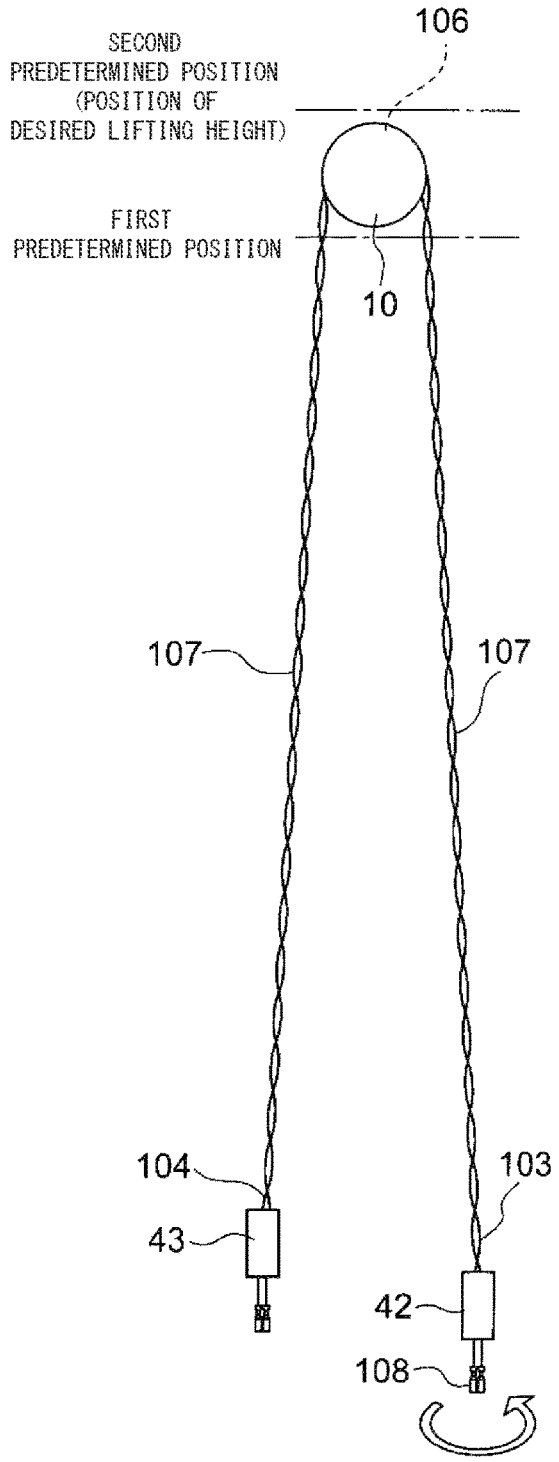
Figure 14A:
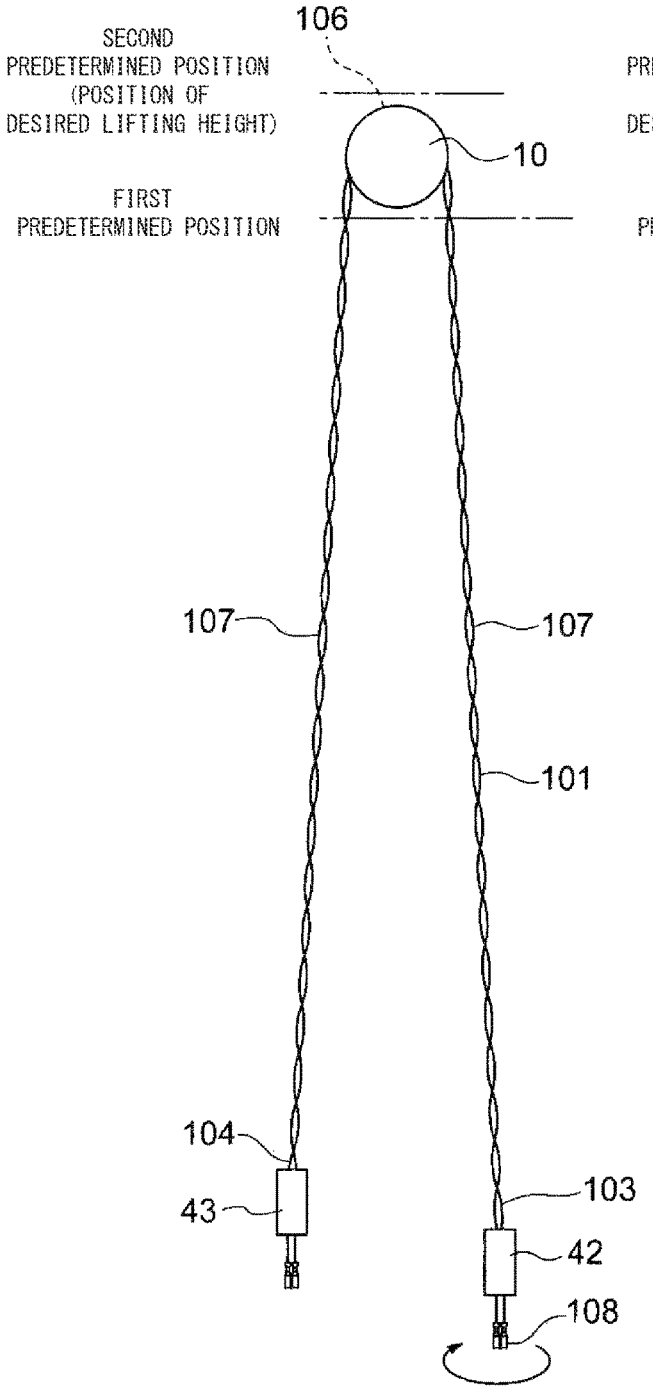
FIGS. 14A and 14B are explanatory views of the electric wire twisting step (twisting on the one end side) of the twisted wire manufacturing method according to the embodiment of the present invention.
Figure 14B:
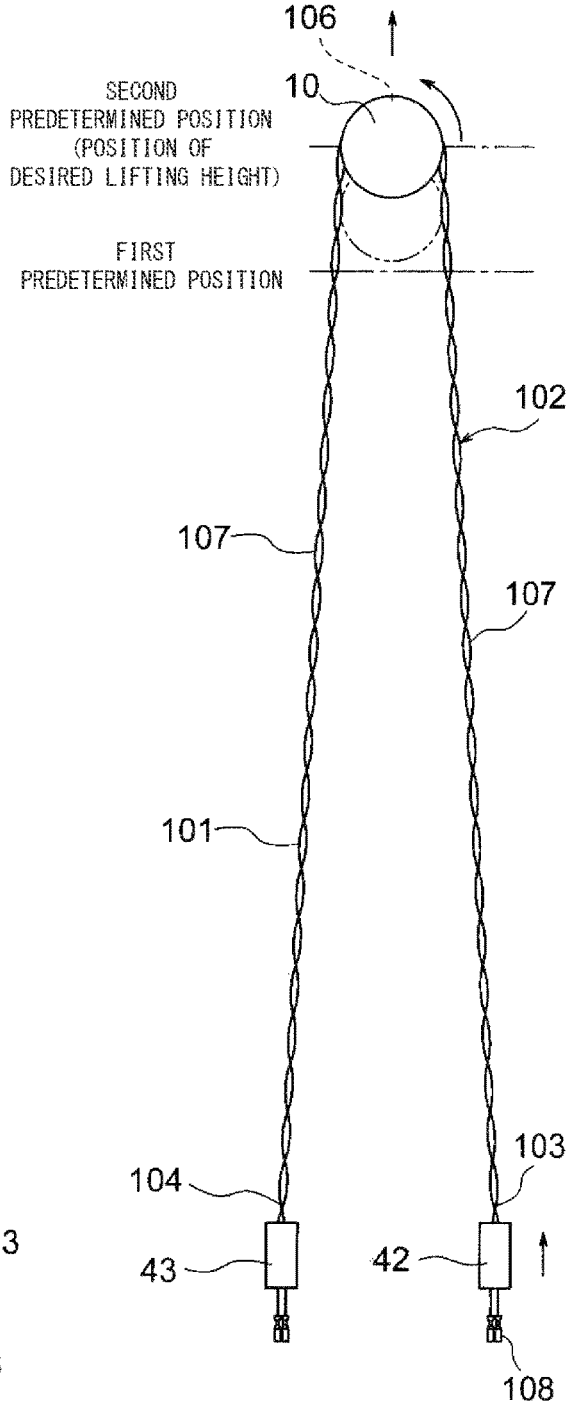

Next, in the fourth step, as shown in FIG. 13B, the one-end chuck portion 42 is rotated by the co-rotation portion 44 on the right side in a direction of the arrow. Next, in the fifth step, as shown in FIG. 14A, the one-end chuck portion 42 is rotated only a few times in the direction opposite to the above (so-called twisting back is performed). Through these two steps, a twisted portion 107 is formed on the right side of the electric wire hanging portion 10. Finally, in the sixth step, the positions of the electric wire hanging portion 10 and the one-end chuck portion 42, which have been changed in the downward direction, are returned to the original positions. Through this step, the twisted portions 107 are arranged at equal lengths on both sides of the electric wire hanging portion 10.

Tape Winding Step:

As shown in FIG. 15A, in this step, operation of tape windings TP is performed. The tape windings TP are formed by winding tapes 54 around ends of the twist portions 107 in the vicinity of the one-end chuck portion 42 and the other-end chuck portion 43. The tape windings TP are applied to prevent dust.

Detachment Step:

As shown in FIG. 15B, in the detachment step, the high-speed/low-speed raising/lowering mechanism 8 is operated to return the position of the electric wire hanging portion 10 from the "second predetermined position (position of desired lifting height)" to the "initial position". Further, the one end 103 and the other end 104 of the twisted wire 102 are detached from the one-end chuck portion 42 and the other-end chuck portion 43. Detachment of the twisted wire 102 completes the series of manufacture.

In the above description, the manufacturing is performed in an order of "electric wire intermediate raising step"→"electric wire one-end chuck step"→ . . . →"electric wire other-end chuck step"→ . . . , but may also be an order of "electric wire intermediate raising step"→"first electric wire lifting step"→"second electric wire lifting step"→"electric wire one-end chuck step"→"electric wire other-end chuck step"→ . . . , for example.

Method for Manufacturing Short Twisted Wire 102:

Next, a method of manufacturing the short twisted wire 102 (manufacturing process) will be described. The manufacturing process may include the electric wire intermediate raising step, the electric wire one-end chuck step, the electric wire lifting step (the third electric wire lifting step), the electric wire other-end chuck step, the electric wire twisting step, the tape winding step, and the detachment step.

Hereinafter, each step will be described with reference to FIGS. 16A to 20B (see also FIGS. 1 to 8 as necessary).

Figure 16A:
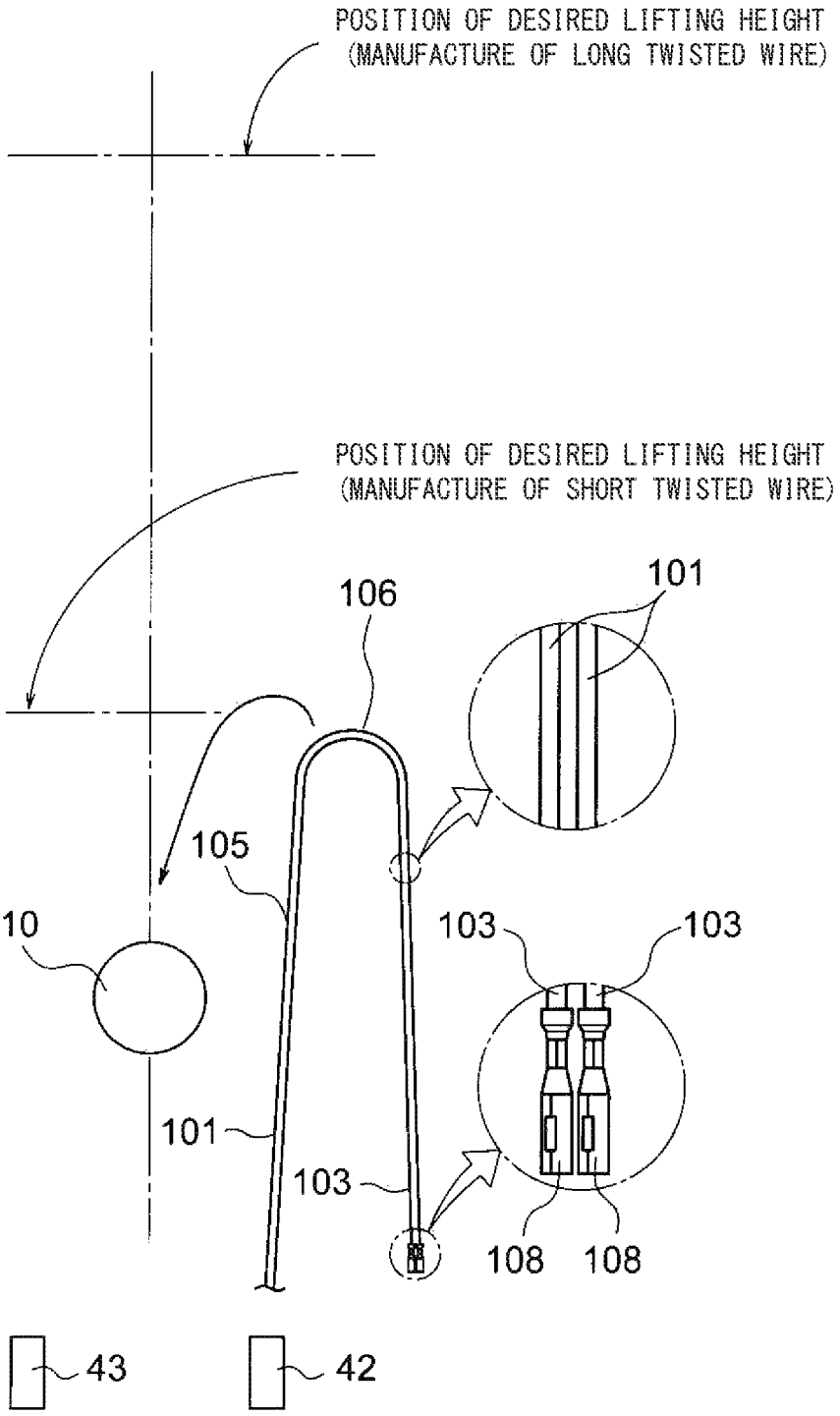
FIGS. 16A and 16B are explanatory views of the electric wire intermediate raising step of the twisted wire manufacturing method (in a case of a short twisted wire) according to the embodiment of the present invention.
Figure 16B:
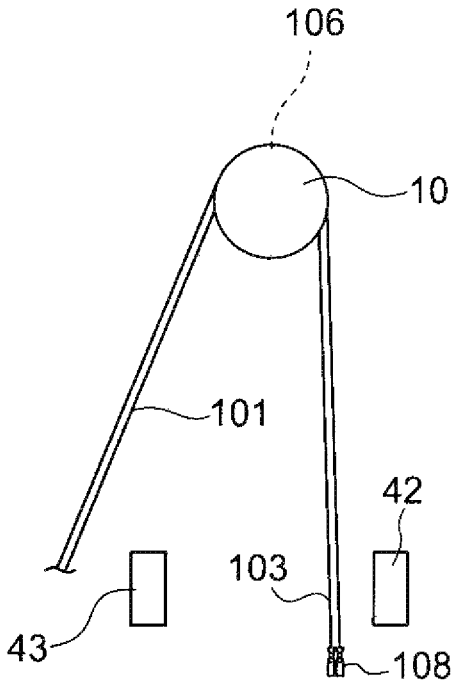

Electric Wire Intermediate Hanging Step:

As shown in FIGS. 16A and 16B, in the electric wire intermediate raising step, the two short electric wires 101 are taken out from a component shelf (electric wire stock shelf) in the vicinity of the operator, and the respective intermediate portions 106 of the two electric wires 101 are hanged on the electric wire hanging portion 10.

Figure 17C:
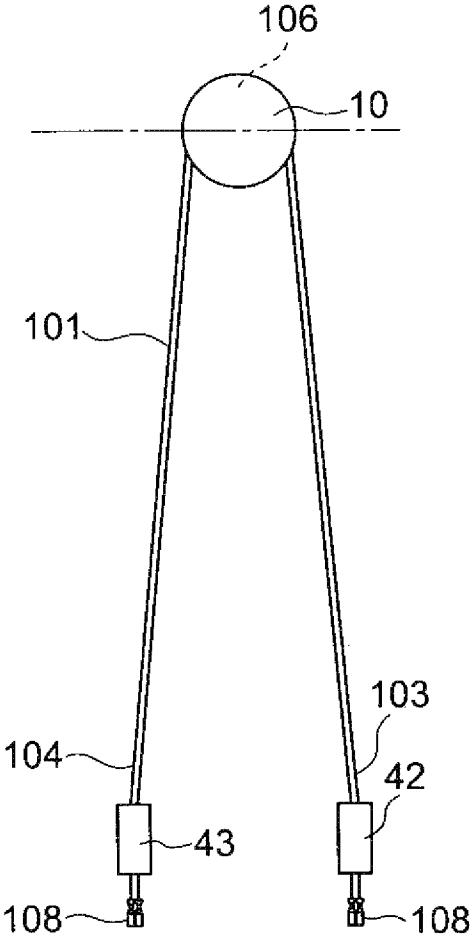
FIGS. 17A-17C are explanatory views of the electric wire one-end chuck step, a third electric wire lifting step, and the electric wire other-end chuck step of the twisted wire manufacturing method according to the embodiment of the present invention.
Figure 17B:
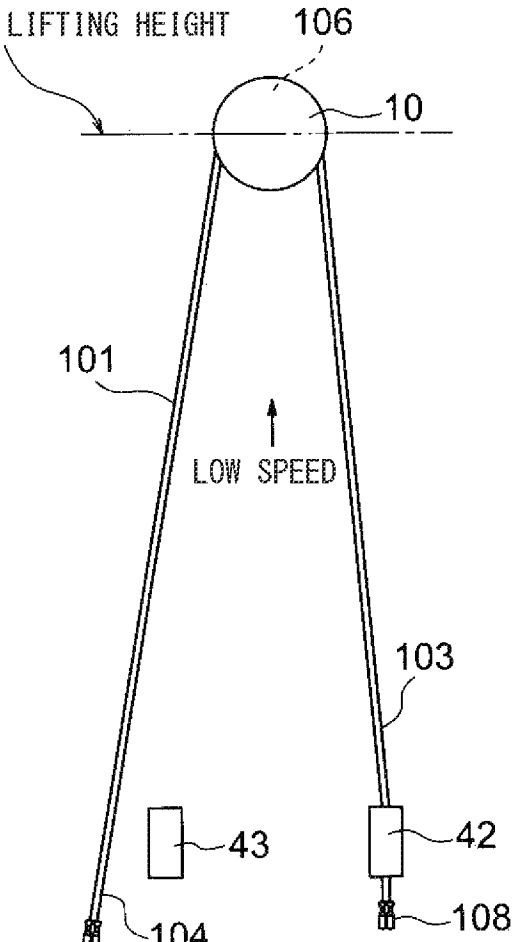
Figure 17A:
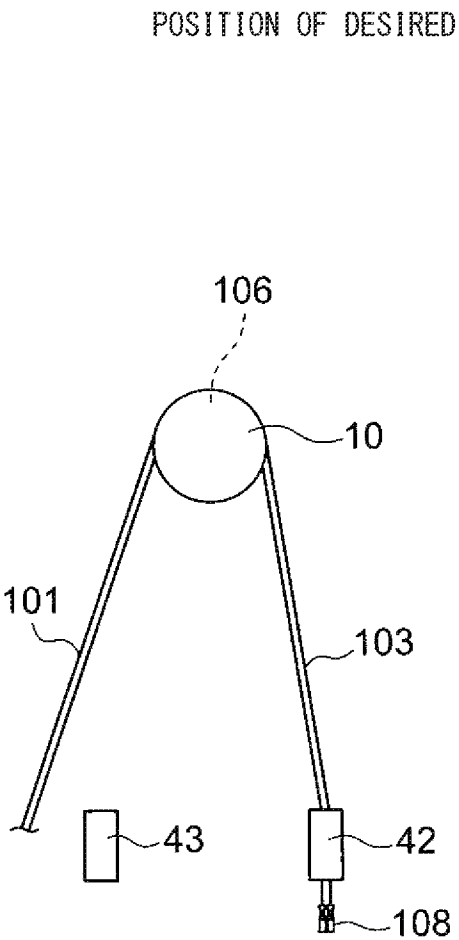

Electric Wire One-End Chuck Step:

As shown in FIG. 17A, in the electric wire one-end chuck step, the one end 103 of the two electric wires 101 is chucked by the one-end chuck portion 42.

Electric Wire Lifting Step (Third Electric Wire Lifting Step):

As shown in FIG. 17B, in the third electric wire lifting step, the high-speed/low-speed raising/lowering mechanism 8 is operated to slowly raise the position of the electric wire hanging portion 10 from the "initial position" to the slightly upper "position of the desired lifting height" at a low speed. When raising at a low speed, since the electric wires 101 are short, the air pressure switching electromagnetic valve portion 28*d* is set to low air pressure through control (command) of the control portion main body 52. Further, the raising/lowering switching electromagnetic valve portion 28*e* is set to raising. When, for example, a button is operated by the operator, the electric wire hanging portion 10 starts being raised slowly. That is, the two electric wires 101 starts being lifted.

The reason why the electric wire lifting process is referred to as the "third" is that the "first" and the "second" are used in the above-described manufacturing method of the twisted wire 102, and that it is necessary to distinguish it from these operations.

In the method for manufacturing the short twisted wire 102, the following operation is performed without using the sensor portions 30 provided in the raising/lowering guidance portion 7. That is, when, for example, a button is operated by the operator, a signal is sent to the control portion main body 52 at the "first predetermined position", a timer functions, and after the electric wire hanging portion 10 is raised slowly for a predetermined time (several seconds), the electric wire hanging portion 10 is stopped exactly at the desired lifting height position.

The control portion main body 52 stores data such as a length (line length) of the electric wires 101, a raising stroke, and a timer time in advance in a time table in a large number of patterns. In a case of manufacturing the short twisted wire 102, the timer time is determined from the length of the electric wires 101 set at the start of manufacturing, and low-pressure air is supplied to the raising/lowering cylinder 27 by the timer time. When the electric wire hanging part 10 is slowly raised and stops at the determined time, the electric wire hanging part 10 exactly comes to the position of the desired lifting height.

Electric Wire Other-end Chuck Step:

As shown in FIG. 17C, in the electric wire other-end chuck step, the other end 104 of the two electric wires 101 is chucked by the other-end chuck portion 43.

Figure 18A:
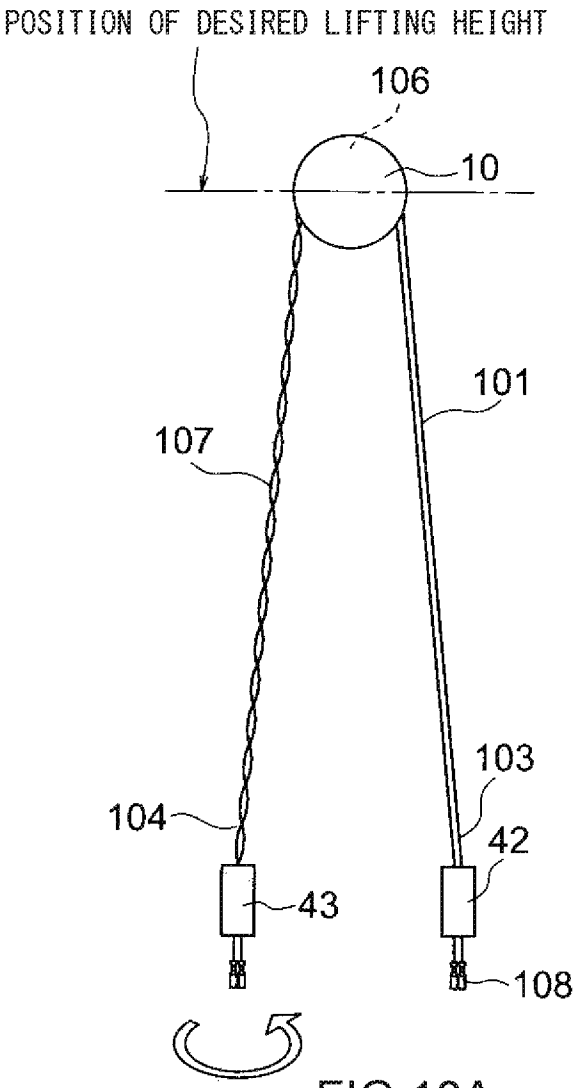
FIGS. 18A-18C are explanatory views of the electric wire twisting step of the twisted wire manufacturing method according to the embodiment of the present invention (twisting on the other end side and movement of the non-twisted portion).

Electric Wire Twisting Step:

As shown in FIG. 18A, in the electric wire twisting step, the following first to sixth steps are performed in order.

Figure 18B:
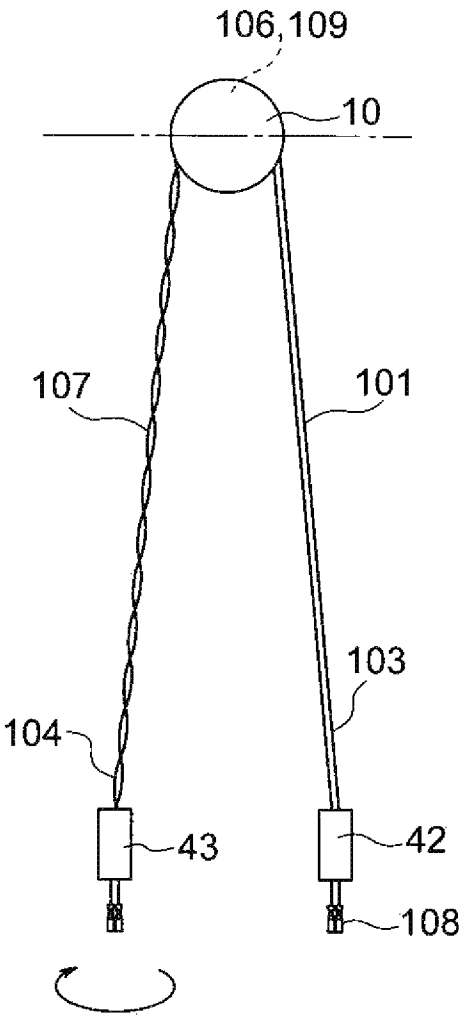
Figure 18C:
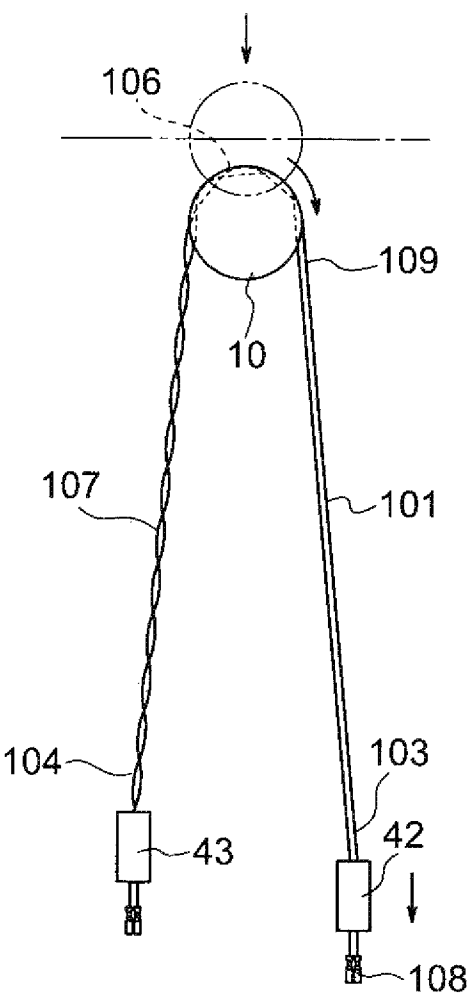

First, in the first step, the other-end chuck portion 43 is rotated by the co-rotation portion 44 on the left side, for example, in a direction of the arrow. Next, in the second step, as shown in FIG. 18B, the other-end chuck portion 43 is rotated only a few times in a direction opposite to the above so as to perform twisting back. Through these two steps, a twisted portion 107 is formed on the left side of the electric wire hanging portion 10. Next, in the third step, as shown in FIG. 18C, the chuck vertical position-changing mechanism 45 is operated to change the positions of the electric wire hanging portion 10 and the one-end chuck portion 42 slightly downward. At this time, the position of the intermediate portion 106 hanged to the electric wire hanging portion 10 is displaced. In other words, a position of an untwisting portion 109 is shifted in a clockwise direction.

Figures 19A, 19B, 19C:
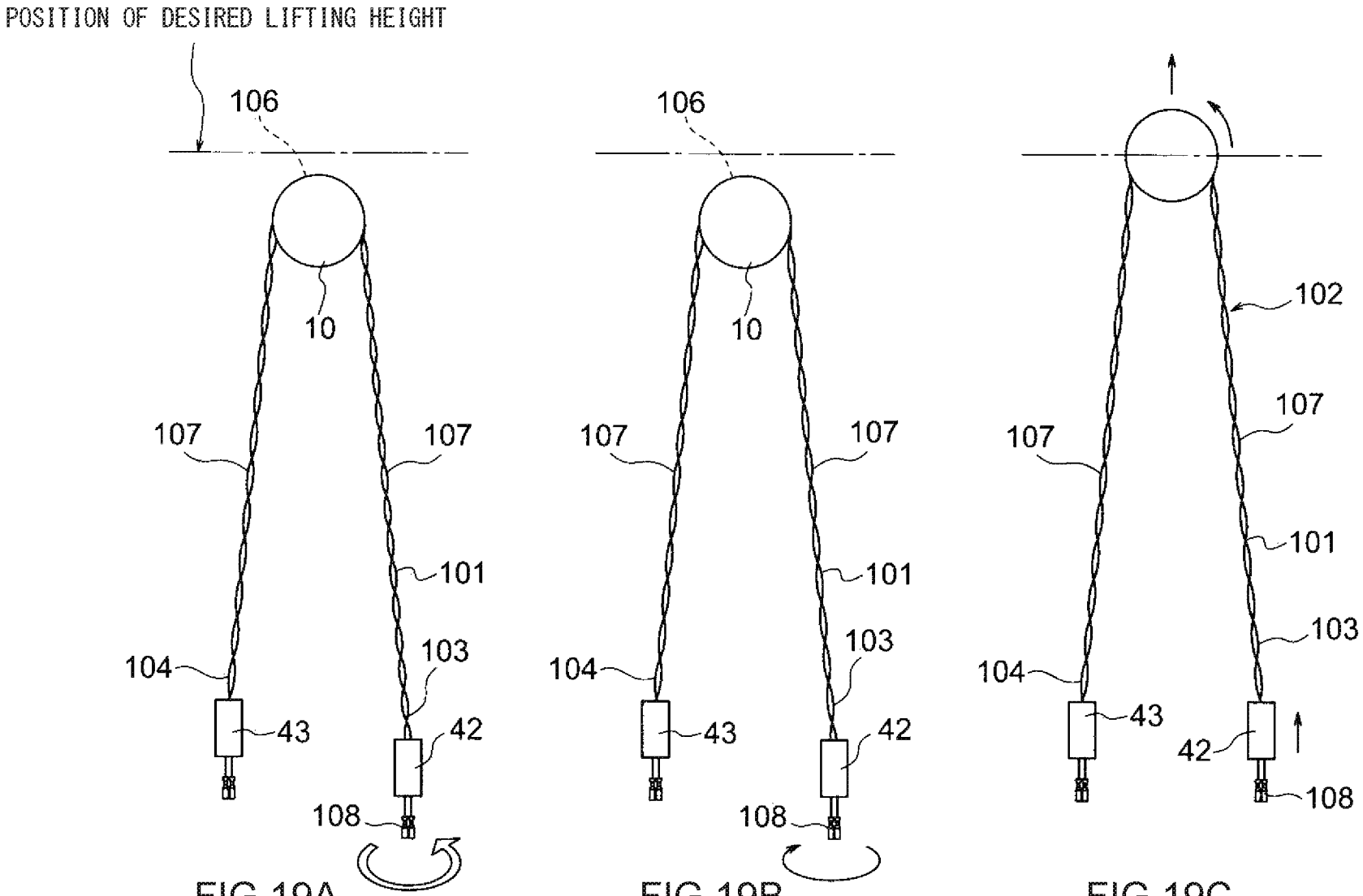
FIGS. 19A-19C are explanatory views of the electric wire twisting step (twisting to the non-twisted portion and twisting of the one end side) of the twisted wire manufacturing method according to the embodiment of the present invention.

Next, in the fourth step, as shown in FIG. 19A, the one-end chuck portion 42 is rotated by the co-rotation portion 44 on the right side in a direction of the arrow. Next, in the fifth step, as shown in FIG. 19A, the one-end chuck portion 42 is rotated only a few times in the direction opposite to the above so as to perform twisting back. Through these two steps, a twisted portion 107 is formed on the right side of the electric wire hanging portion 10. Finally, in the sixth step, the positions of the electric wire hanging portion 10 and the one-end chuck portion 42, which have been changed in the downward direction, are returned to the original positions as shown in FIG. 19C. Through this step, the twisted portions 107 are arranged at equal lengths on both sides of the electric wire hanging portion 10.

Figure 20B:
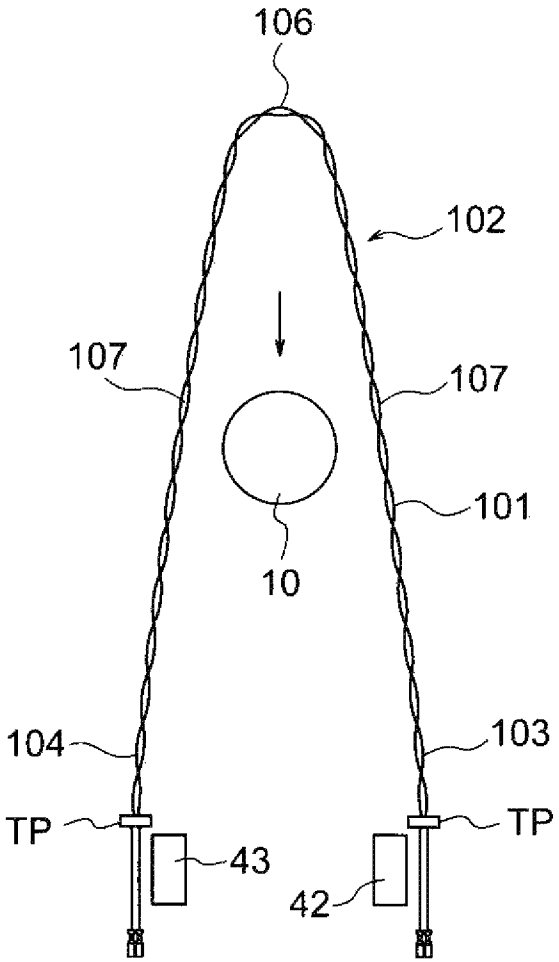
FIGS. 20A and 20B are explanatory views of the tape winding step and the detachment step of the twisted wire manufacturing method according to the embodiment of the present invention.
Figure 20A:
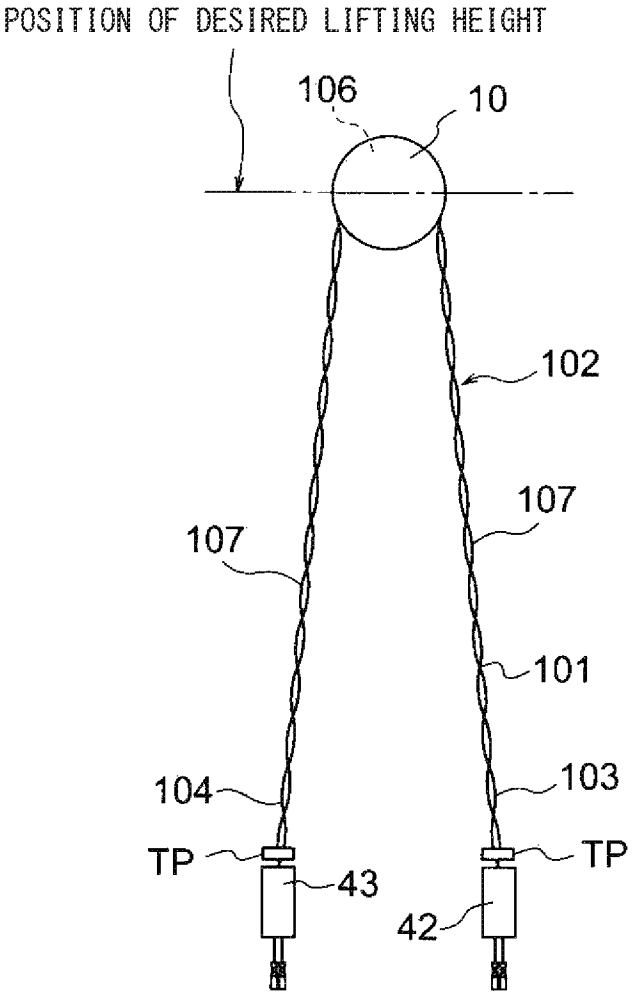

Tape Winding Step:

As shown in FIG. 20A, in this step, operation of tape windings TP is performed. The tape windings TP are formed at ends of the twist portions 107 in the vicinity of the one-end chuck portion 42 and the other-end chuck portion 43. The tape windings TP are applied to prevent dust.

Detachment Step:

As shown in FIG. 20B, in the detachment step, the high-speed/low-speed raising/lowering mechanism 8 is operated to return the position of the electric wire hanging portion 10 from the "position of desired lifting height" to the "initial position". Further, the one end 103 and the other end 104 of the twisted wire 102 are detached from the one-end chuck portion 42 and the other-end chuck portion 43. Removal of the twisted wire 102 completes the series of manufacture.

Effect of Twisted Wire Manufacturing Apparatus 1 and Manufacturing Method:

As described above with reference to FIGS. 1 to 21B, since the twisted wire manufacturing apparatus 1 and the manufacturing method are an apparatus and a method of a configuration and structure such that a space required for manufacturing the twisted wire 102 is ensured in the vertical direction instead of the horizontal direction as in a conventional example, it is possible to significantly reduce the overall length of the apparatus as compared to the conventional example.

Since the twisted wire manufacturing apparatus 1 and the manufacturing method are an apparatus and a method of a configuration and structure such that manufacturing is performed with the one end 103 and the other end 104 of the two electric wires 101 disposed close to each other, the end positions of the completed twisted wire 102 are close to the operator, and the operator does no need to move to the end position as in the conventional example, which significantly reduces the burden on the operator.

Since the twisted wire manufacturing apparatus 1 and the manufacturing method are an apparatus and a method of a configuration and structure capable of changing the raising/lowering speed when the two electric wires 101 are lifted, for example, by switching the raising/lowering speed from the high speed to the low speed in front of the position of the desired lifting height in a case of manufacturing the long twisted wire 102, or by maintaining the raising/lowering speed at the low speed from the initial position to the desired lifting height position in a case of manufacturing the short twisted wire 102, a large tensile force is not abruptly generated with respect to the two electric wires 101, and troubles such as detachment of the electric wires at the one-end chuck portion 42 and the other-end chuck portion 43 can be prevented.

As can be seen from the above, according to the present invention, it is possible to provide the twisted wire manufacturing apparatus 1 and the method capable of reducing the installation space or the like, improving the workability, and preventing a large tension from being applied to the two electric wires 101.

Since the disclosure is an apparatus and a method of a configuration and structure hanging and lifting the respective intermediate portions 106 generated in the middle of the two electric wires 101, the manufactured twisted wire 102 can be bent into a U shape at the upper portion thereof. As a result, since the height of the apparatus is ½, the installation space can be further reduced.

Although the sensor portion 30 at the substantially central position in the raising/lowering guidance portion 7 (see FIG. 1; corresponding to the reference numeral 30*a*) is set as the "first predetermined position" in the above description, in a case where the long twisted wire 102 is required to be manufactured, for example, the position of the uppermost sensor portion 30 in FIG. 1 (corresponding to the reference numeral 30*b*) may be set as the "first predetermined position". As a result, although not particularly shown, it is possible to manufacture a longer twisted wire 102.

Although a detailed description is omitted, in a case of manufacturing the short twisted wire 102, the one end 103 and the other end 104 of the two electric wires 101 may be, for example, chucked by the first chuck portion 42 and the right optional chuck portion 13, and then twisted by rotating the one-end chuck portion 42.

Although specific embodiments have been described above, the present invention is not limited to the appearance and configuration thereof, and various modifications, additions, and deletions may be made without departing from the scope of the invention.

The features of the embodiments of the twisted wire manufacturing apparatus and the twisted wire manufacturing method according to the present invention will be briefly summarized in [1] to [4] below.

[1] An apparatus (1) for manufacturing a twisted wire by twisting a plurality of electric wires (101), the apparatus (1) comprising:

a raising and lowering unit (2) lifting the plurality of the electric wires (101) and lowering the manufactured twisted wire;

a twisting unit (3) disposed with the raising and lowering unit (2) and twisting the plurality of the electric wires (101); and a control unit (4) controlling at least the raising and lowering unit (2), the raising and lowering unit (2) having:

a raising and lowering portion (6); a guiding portion (7) vertically guiding the raising and lowering portion (6); and a raising and lowering mechanism (8) capable of switching a raising and lowering speed of the raising and lowering portion (6) to a high speed or a low speed.

[2] The apparatus (1) according to the item [1], wherein the raising and lowering portion (6) has:

a hanging portion (10) hanging and lifting intermediate portions (106) between both ends of the electric wires (101); and a main body (9) of the raising and lowering portion (6), the main body (9) being combined with the electric wire hanging portion (10).

[3] The apparatus (1) according to the item [2], wherein the twisting unit (3) has:

a one-end chuck portion (42) chucking one end of the electric wires (101); an other-end chuck portion (43) chucking the other end of the electric wires (101); a co-rotation portion (44) rotating the one-end chuck portion (42) and the other-end chuck portion (43) in the same direction at different timings; and a position-changing mechanism (45) changing positions of the one-end chuck portion (42) and the other-end chuck portion (43) in a vertical direction.

[4] A method for manufacturing a twisted wire by twisting a plurality of electric wires (101), the method comprising:

hanging (FIGS. 9A and 9B) intermediate portions (106) between both ends of the electric wires (101) to a hanging portion (10);

chucking (FIG. 10A) one end of the electric wires (101) to an one-end chuck portion (42);

lifting (FIGS. 10B and 11A) the electric wires (101) to a position of a preset lifting height through movement of the hanging portion (10) in a state of the intermediate portions (106) being hanged to the hanging portion (10) and the one end of the electric wires (101) being chucked to the one-end chuck portion (42);

chucking (FIG. 11B) the other end of the electric wires (101) to an other-end chuck portion (43) after lifting the electric wires (101) to the position of the preset lifting height; and twisting (FIG. 12A) the electric wires (101) in a state of the electric wires (101) being raised to the position of the preset lifting height and the one end and the other end of the electric wires (101) being chucked, the lifting step including:

both of a first lifting step (FIG. 10B) lifting the electric wires (101) at a high speed to a first preset position lower than the position of the preset lifting height; and a second lifting step (FIG. 11A) lifting the electric wire located at the first preset position at a low speed to a second preset position corresponding to the position of the preset lifting height, or, the lifting step including:

a third lifting step (FIGS. 17A-17C) lifting the electric wires (101) at the low speed to the position of the preset lifting height.

According to the twisted wire manufacturing apparatus and the twisted wire manufacturing method according to the present configuration, it is possible to reduce the installation space and to improve the workability without causing excessive tension in the electric wire. That is, the present invention having this effect is useful as a twisted wire manufacturing apparatus and a twisted wire manufacturing method.

REFERENCE SIGNS LIST

1 Twisted wire manufacturing apparatus
2 Electric wire lifting unit
3 Electric wire twisting unit
4 Control unit
5 Frame
6 Raising/lowering portion
7 Raising/lowering guidance portion
8 High-speed/low-speed raising/lowering mechanism
9 Raising/lowering portion main body
10 Electric wire hanging portion
11 Electric wire pressing portion
12 Tension application portion
13 Optional chuck portion
14 Electric wire guard
15 Upper main body
16 Lower main body
17 Front wall
18 Left side wall
19 Right side wall
20 Rear wall
21 Guidance protrusion
22 Recess
23 Mounting portion
25 Guidance recess
27 Raising/lowering cylinder
28 Air supply device
29 Connecting arm
30 Sensor portion
31 Light-shielding portion
32 Light-shielding piece
33 Sensor portion
34 Box
35 Power supply apparatus
36 Signal line
37 Sensor main body
38 Light emission portion
39 Light receipt portion
40 Space
41 Attachment portion
42 One-end chuck portion
43 Other-end chuck portion
44 Co-rotation portion
45 Chuck vertical position-changing mechanism
46 Motor
47 Rotation shaft
48 Motor fixing portion
49 Lowering cylinder
50 Air supply apparatus
51 Slider rail

52 Control portion main body
53 Operation portion
54 Tape
101 Electric wire
102 Twisted wire
103 One end
104 Other end
105 Middle
106 Intermediate portion
107 Twisted portion
108 Terminal fitting
109 Non-twisted portion
TP Tape winding

The invention claimed is:

1. An apparatus for manufacturing a twisted wire by twisting a plurality of electric wires, the apparatus comprising:

a raising and lowering unit lifting the plurality of the electric wires and lowering the manufactured twisted wire;

a twisting unit disposed with the raising and lowering unit and twisting the plurality of the electric wires; and a control unit controlling at least the raising and lowering unit, the raising and lowering unit having:

a raising and lowering portion; a guiding portion vertically guiding the raising and lowering portion; and a raising and lowering mechanism capable of switching a raising and lowering speed of the raising and lowering portion to a high speed or a low speed.

2. The apparatus according to claim 1, wherein the raising and lowering portion has:

a hanging portion hanging and lifting intermediate portions between both ends of the electric wires; and a main body of the raising and lowering portion, the main body being combined with the electric wire hanging portion.

3. The apparatus according to claim 2, wherein the twisting unit has:

a one-end chuck portion chucking one end of the electric wires; an other-end chuck portion chucking the other end of the electric wires; a co-rotation portion rotating the one-end chuck portion and the other-end chuck portion in the same direction at different timings; and a position-changing mechanism changing positions of the one-end chuck portion and the other-end chuck portion in a vertical direction.

4. A method for manufacturing a twisted wire by twisting a plurality of electric wires, the method comprising:

hanging intermediate portions between both ends of the electric wires to a hanging portion;

chucking one end of the electric wires to an one-end chuck portion;

lifting the electric wires to a position of a preset lifting height through movement of the hanging portion in a state of the intermediate portions being hanged to the hanging portion and the one end of the electric wires being chucked to the one-end chuck portion;

chucking the other end of the electric wires to an other-end chuck portion after lifting the electric wires to the position of the preset lifting height; and twisting the electric wires in a state of the electric wires being raised to the position of the preset lifting height and the one end and the other end of the electric wires being chucked, the lifting step including:

both of a first lifting step lifting the electric wires at a high speed to a first preset position lower than the position of the preset lifting height; and a second lifting step lifting the electric wire located at the first preset position at a low speed to a second preset position corresponding to the position of the preset lifting height, or, the lifting step including:

a third lifting step lifting the electric wires at the low speed to the position of the preset lifting height.

* * * * *